US010789886B2

(12) United States Patent
Wakata et al.

(10) Patent No.: US 10,789,886 B2
(45) Date of Patent: Sep. 29, 2020

(54) DISPLAY DEVICE

(71) Applicant: Sharp Kabushiki Kaisha, Sakai, Osaka (JP)

(72) Inventors: Kuniharu Wakata, Sakai (JP); Takeshi Yaneda, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/066,336

(22) PCT Filed: Mar. 27, 2017

(86) PCT No.: PCT/JP2017/012301

§ 371 (c)(1),
(2) Date: Sep. 13, 2019

(87) PCT Pub. No.: WO2018/179034

PCT Pub. Date: Oct. 4, 2018

(65) Prior Publication Data

US 2020/0168153 A1 May 28, 2020

(51) Int. Cl.

| | |
|---|---|
| ***G09G 3/3258*** | (2016.01) |
| ***G09F 9/30*** | (2006.01) |
| ***G09G 3/3266*** | (2016.01) |
| ***G09G 3/3291*** | (2016.01) |

(52) U.S. Cl.

CPC ..... *G09G 3/3258* (2013.01); *G09F 9/301* (2013.01); *G09G 3/3266* (2013.01); *G09G 3/3291* (2013.01); *G09G 2380/02* (2013.01)

(58) Field of Classification Search

CPC .. G09G 3/3258; G09G 3/3266; G09G 3/3291; G09G 2380/02; G09F 9/301

USPC ..... 345/204

See application file for complete search history.

(56) References Cited

U.S. PATENT DOCUMENTS

2002/0196205 A1* 12/2002 Yamakado ..... G09G 3/3208 345/33
2005/0012454 A1* 1/2005 Yamazaki ..... H01L 27/3279 313/506
2008/0150846 A1* 6/2008 Chung ..... G09G 3/3233 345/80

(Continued)

FOREIGN PATENT DOCUMENTS

JP 2002-328625 A 11/2002
JP 2005-38833 A 2/2005

(Continued)

OTHER PUBLICATIONS

Official Communication issued in International Patent Application No. PCT/JP2017/012301, dated Jun. 20, 2017.

*Primary Examiner* — Mark Edwards
(74) *Attorney, Agent, or Firm* — Keating & Bennett, LLP

(57) ABSTRACT

A display device includes a first voltage primary wiring line that supplies a first voltage to respective pixel circuits of a display unit and a second voltage primary wiring line that supplies a second voltage to respective pixel circuits. An end portion of an unrolled area of the display unit, positioned on an opposite side with respect to a rolling mechanism, is provided as an edge portion. At least one of the first voltage primary wiring line and the second voltage primary wiring line is electrically connected to pixel circuits arranged at the edge portion first, out of the plurality of pixel circuits.

19 Claims, 16 Drawing Sheets

(56) References Cited

U.S. PATENT DOCUMENTS

| | | | | |
|---|---|---|---|---|
| 2016/0112667 | A1* | 4/2016 | Park | G06F 1/1601 348/739 |
| 2016/0202781 | A1* | 7/2016 | Kim | G06F 1/1652 345/173 |
| 2016/0307545 | A1* | 10/2016 | Lee | G09G 5/38 |
| 2016/0358552 | A1* | 12/2016 | Wang | G09G 3/342 |
| 2017/0367198 | A1* | 12/2017 | Park | H01L 51/5237 |
| 2018/0068612 | A1* | 3/2018 | Cho | G09G 3/3208 |

FOREIGN PATENT DOCUMENTS

| | | | |
|---|---|---|---|
| JP | 2014-10597 | A | 1/2014 |
| JP | 2016-218326 | A | 12/2016 |
| WO | 2009/072422 | A1 | 6/2009 |

* cited by examiner

DISPLAY DEVICE

TECHNICAL FIELD

The disclosure relates to a display device that includes a deformable display unit having flexibility.

BACKGROUND ART

PTL 1 discloses a technology to display images, using a deformable display unit having flexibility (for example: Electro Luminescence (EL) Display). Specifically, PTL 1 discloses a display device in which images are displayed on an unrolled part (unrolled area) of a rollable display unit.

CITATION LIST

Patent Literature

PTL 1: JP 2016-218326 A (published on Dec. 22, 2016).

SUMMARY

Technical Problem

A rolled part (rolled area) of the display unit has a smaller heat dissipation area than an unrolled area. Thus, when a current flows in the rolled area, the temperature of the rolled area increases, thus deteriorating the display device.

Solution to Problem

In order to solve the aforementioned problems, a display device of a first aspect of the disclosure includes: a display unit including a plurality of pixel circuits each including an electro-optic element, the display unit being deformable and having flexibility; a rolling mechanism configured to roll the display unit and store a rolled part of the display unit as a rolled area in an interior of the rolling mechanism; a power source circuit; a first voltage primary wiring line configured to supply a first voltage from the power source circuit to at least one of the plurality of pixel circuits; and a second voltage primary wiring line configured to supply a second voltage lower than the first voltage from the power source circuit to at least one of the plurality of pixel circuits, wherein an area of the display unit excluding the rolled area on the display unit includes an unrolled area, and an end portion of the unrolled area of the display unit positioned on an opposite side with respect to the rolling mechanism includes a lowermost edge portion, and at least one of the first voltage primary wiring line and the second voltage primary wiring line is electrically connected to pixel circuits arranged at the lowermost edge portion first, out of the plurality of pixel circuits.

Advantageous Effects of Disclosure

In accordance with the display device of one aspect of the disclosure, the deterioration of the display device due to an increase in temperature of the rolled area can be prevented.

DESCRIPTION OF EMBODIMENTS

First Embodiment

Figure 1A:
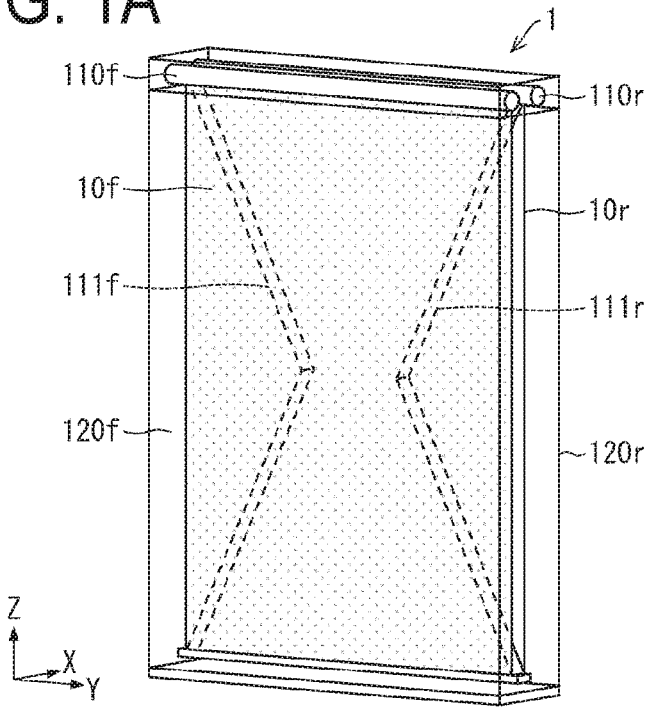
FIG. 1A is a perspective view illustrating a state where a display unit of a display device of a first embodiment is not rolled.

Hereinafter, a description follows regarding a first embodiment of the disclosure, with reference to FIGS. 1A to 10B. In the first embodiment, a display device 1 that includes two display units (for example, EL display) having flexibility is described. Hereinafter, for the convenience of description, the respective two display units are referred to as display units 10*f* and 10*r* to distinguish between the two display units. Further, when it is not required to distinguish between the two display units 10*f* and 10*r*, the display units are collectively referred to as display units 10.

Note that various members of the display device 1 are illustrated in respective drawings described below, but the descriptions of members that are not related to the first embodiment are omitted. It is to be understood that the members, of which the descriptions are omitted, are similar to known members. Note that the purpose of the drawings is to schematically describe the shape, structure, and positional relation of each member and are not necessarily illustrated on the actual scale.

Overview of Display Device 1

First, an overview of the display device 1 will be described with reference to FIGS. 1A and 1B. The display device 1 includes the display units 10*f* and 10*r*, rolling mechanisms 110*f* and 110*r*, and protecting members 120*f* and 120*r*. Each of the rolling mechanisms 110*f* and 110*r* includes link members 111*f* and 111*r* (for example, pantograph links). The rolling mechanisms 110*f* and 110*r* may be collectively referred to as rolling mechanisms 110 (see FIG. 4 described later).

Note that the rolling mechanism 110*f*, the link member 111*f*, and the protecting member 120*f* are members provided to the display unit 10*f*. Similarly, the rolling mechanism 110*r*, the link member 111*r*, and the protecting member 120*r* are members provided to the display unit 10*r*.

In the description below, unless particularly necessary, only the rolling mechanism 110*f*, the link member 111*f*, and the protecting member 120*f* are described. Respective functions of the rolling mechanism 110*r*, the link member 111*r*, and the protecting member 120*r* are similar to those of the rolling mechanism 110*f*, the link member 111*f*, and the protecting member 120*f*, and thus their descriptions are omitted. In this respect, the same goes for other members with the same subscripts "f" and "r" (for example, position sensors 16*f* and 16*r* in FIG. 4), which are described later.

Hereinafter, for the convenience of description, the longitudinal direction of the display unit 10*f* (that is, the display unit 10*f* illustrated in FIG. 1A described below) in an unrolled state described later is referred to as a Z direction. In the first embodiment, the negative Z direction is referred to as a downward direction. Similarly, the positive Z direction is referred to as an upward direction. The Z direction may be referred to as a height direction (up-and-down direction). The Z direction may be the vertical direction or the horizontal direction (the direction perpendicular to the vertical direction).

Similarly, the lateral direction of the display unit 10 in the unrolled state is referred to as a Y direction. The Y direction may be referred to as a width direction. Similarly, the direction orthogonal to the Y direction and Z direction is referred to as an X direction. The X direction may be referred to as a depth direction.

The display unit 10*f* (first display unit) is a deformable display unit having flexibility. The display unit 10*f* may be a known EL display (for example, organic EL display). More specifically, the display unit 10*f* is formed in a sheet shape (film shape) to be rollable.

A side (side in the negative direction of X-axis in FIGS. 1A and 1B) where an active area (displayable area) of the display unit 10*f* is provided is referred to as the front side of the display unit 10*f*. Similarly, a side opposite to the front side of the display unit 10*f* is referred to as the back side of the display unit 10*f*. The display unit 10*f* displays (shows) images to a user (viewer) facing the front side of the display unit 10*f*.

In the display unit 10*r* (second display unit), an active area is provided on a side opposite to the display unit 10*f*. A side (side in the positive direction of X-axis in FIGS. 1A and 1B) where the active area of the display unit 10*r* is provided is referred to as the front side of the display unit 10*r*. Similarly, a side opposite to the front side of the display unit 10*r* is referred to as the back side of the display unit 10*r*. The display unit 10*r* displays images to the user facing the front side of the display unit 10*r*.

Figure 1B:
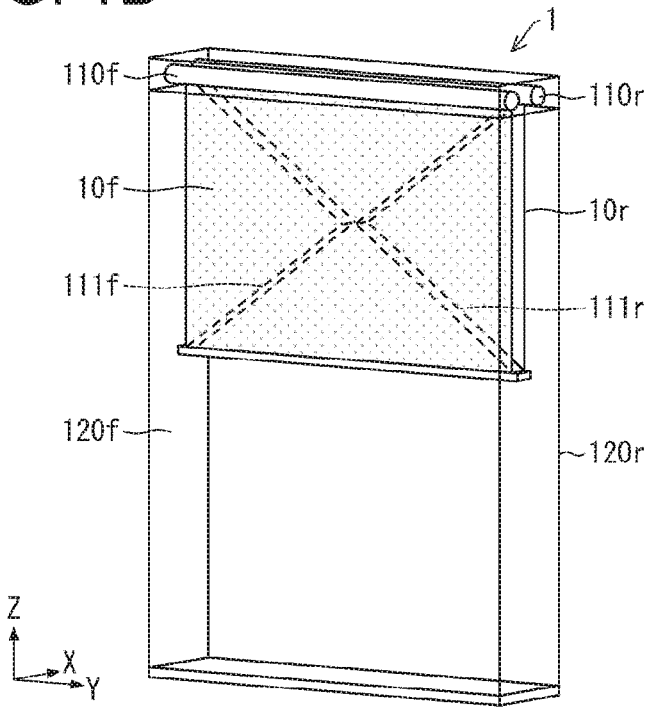
FIG. 1B is a perspective view illustrating a state where part of the display unit is rolled.

As illustrated in FIGS. 1A and 1B, when the display unit 10*f* and the display unit 10*r* are provided, the front side of the display unit 10*r* is positioned on the back side of the display unit 10*f*. Similarly, the back side of the display unit 10*r* is positioned on the front side of the display unit 10*f*. Thus, the display device 1 can display images on the side in the negative direction and on the side in the positive direction of the X-axis of FIGS. 1A and 1B. The display device 1, for example, may be used as a double-sided signage.

The rolling mechanism 110*f* is a mechanism to roll up (take up) the display unit 10*f*. The rolling mechanism 110*f* rolls up the display unit 10*f* by reducing a length H in the height direction of the link member 111*f*. Further, at least part of the rolled area described later is drawn out (sent out) from the rolling mechanism 110*f* to the outside of the rolling mechanism 110*f* by increasing the length H. The rolling mechanism 110*f* includes a driving unit (for example, a motor), not illustrated, to drive the link member 111*f*. The structure of the link member 111*f* is known, and thus its description is omitted.

In the first embodiment, for the convenience of description, a case where the display unit 10*f* (unrolled area) is drawn out in the downward direction (for example, the vertical direction) of the rolling mechanism 110*f* is exemplified. However, the direction in which the display unit 10*f* is drawn out by the rolling mechanism is not particularly limited to the downward direction. The aforementioned direction, for example, may be a direction opposite to the vertical direction, or may be a direction (horizontal direction) orthogonal to the vertical direction.

FIG. 1A is a perspective view illustrating a state (unrolled state) where the display unit 10*f* is not rolled. Herein, the equilibrium length in the Z direction of the display unit 10*f* is referred to as a length L0 (maximum length). Further, a length in the height direction from the rolling mechanism 110*f* (more specifically, the lower end of the rolling mechanism 110*f*) to the lower end of the display unit 10*f* is referred to as a length La (exposure length). In the unrolled state, La is equal to L0.

The rolling mechanism 110*f* operates the link member 111*f* and equates the length H with the length L0, thereby rolling down the display unit 10*f* to its maximum. That is, the rolling mechanism 110*f* increases the length La to the length L0 and puts the display unit 10*f* in the unrolled state.

Hereinafter, an unrolled part (part with the length La, hanging in the downward direction of the rolling mechanism 110*f*) of the display unit 10*f* is referred to as an unrolled area. In the unrolled state, the whole of the display unit 10*f* is the unrolled area. In the unrolled state, the whole of the display unit 10*f* is provided for a user as an area (visually recognizable area) on which the user can visually recognize images.

FIG. 1B is a perspective view illustrating a state (partially rolled state) where part of the display unit 10*f* is rolled. The rolling mechanism 110*f* operates the link member 111*f* to reduce the length La, such that the length La is less than the length L0. That is, the rolling mechanism 110*f* rolls up the display unit 10*f* and puts the rolled up display unit 10*f* in a rolled state.

In the partially rolled state, a rolled part of the display unit 10*f* is referred to as a rolled area. In the partially rolled state, the rolled area of the display unit 10*f* is stored in the interior of the rolling mechanism 110*f*. When the length of the rolled area of the display unit 10*f* is represented as Lb (non-exposure length, storage length), Lb=L0−La. In the partially rolled state, 0<Lb<L0 holds true. Note that in the aforementioned unrolled state, Lb=0.

In the partially rolled state, the rolled area of the display unit 10*f* is an area (visually unrecognizable area) on which the user cannot visually recognize images. That is, the unrolled area, which is an area excluding the rolled area from the whole of the display unit 10*f*, is provided for the user as a visually recognizable area. As described later, the display device 1 displays images only on the unrolled area of the display unit 10*f* in the partially rolled state.

The protecting member 120*f* is a plate-shaped member formed of a transparent material such as glass or resin. The protecting member 120*f* is provided to protect the display unit 10*f* without impairing the viewability of a user who views images displayed on the display unit 10*f*. For example, the provision of the protecting member 120*f* can prevent the user from touching the display unit 10*f*.

Figure 2:
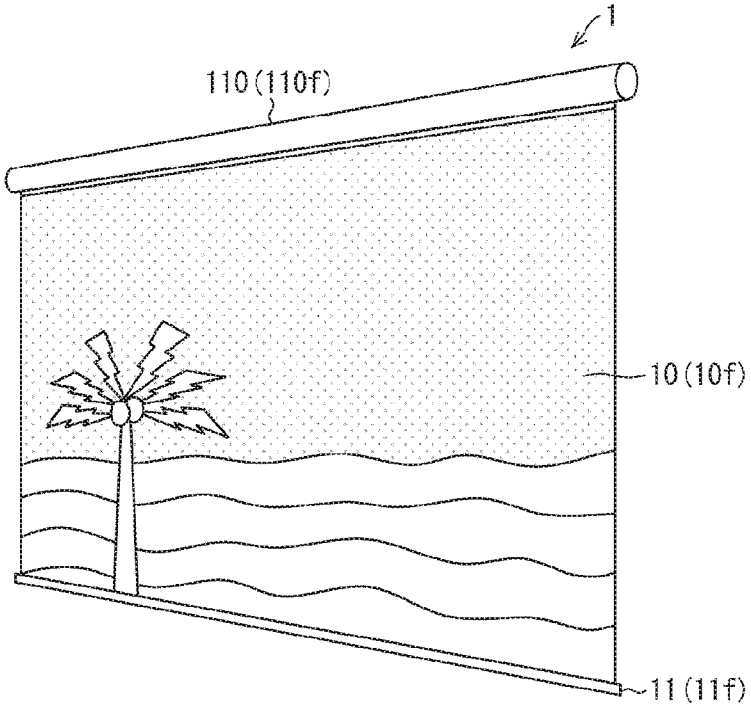
FIG. 2 is a view schematically illustrating a configuration of the display unit of FIGS. 1A and 1B.

FIG. 2 is a view schematically illustrating the configuration of the display unit 10. In FIG. 2, for the convenience of description, only the display unit 10*f* in the unrolled state is illustrated. Further, in FIG. 2, the illustration of the link member 111*f* and the protecting member 120*f* is omitted. As illustrated in FIG. 2, the display unit 10*f* includes an edge portion 11*f* (lowermost edge portion) at the lower end thereof. The edge portion 11*f* is an end portion in the unrolled area that is positioned on the opposite side of the rolling mechanism 110*f*.

Figure 5A:
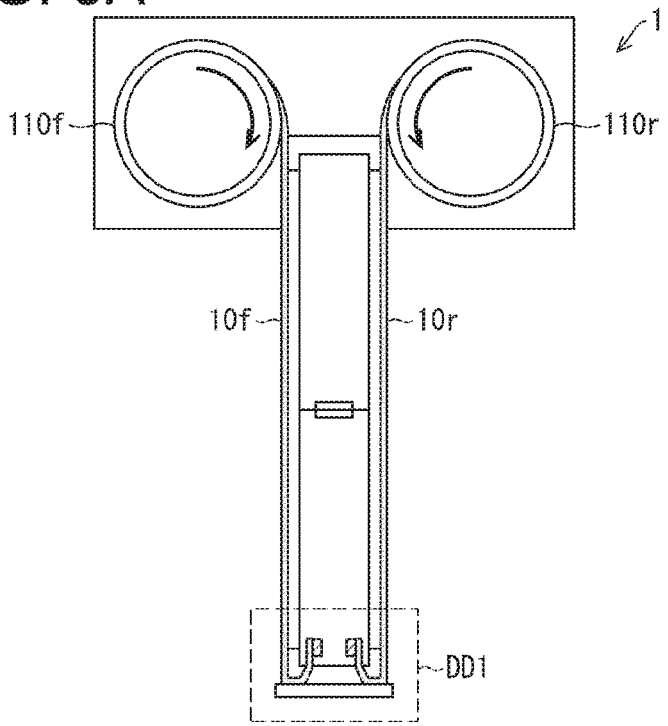
FIG. 5 is a schematic side view of the display device of FIGS. 1A and 1B.
FIG. 5B is an enlarged view of an area DD1 in FIG. 5A.
Figure 5B:
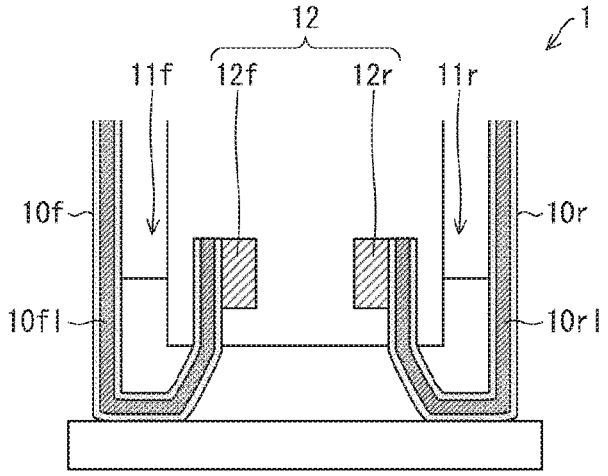

As illustrated in FIG. 5B described later, a terminal 12*f* is provided at the edge portion 11*f* of the display unit 10*f*. Similarly, as illustrated in FIG. 5B, an edge portion 11*r* (lowermost edge portion) similar to the edge portion 11*f* is provided in the display unit 10*r*. Further, a terminal 12*r* similar to the terminal 12*f* is provided at a U-shaped end portion of the edge portion 11*r*. The edge portions 11*f* and 11*r* may be collectively referred to as an edge portion 11 (lowermost edge portion) and the terminals 12*f* and 12*r* may be collectively referred to as a terminal 12. The terminal 12 provided at the edge portion 11 may be used in the display device 1 as a terminal to receive a signal inputted from outside.

Figure 3A:
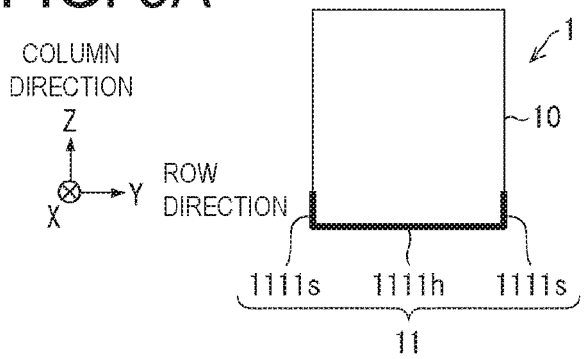
FIGS. 3A to 3C are views for describing a lowermost edge portion provided in the display unit of FIGS. 1A and 1B.
Figure 3B:
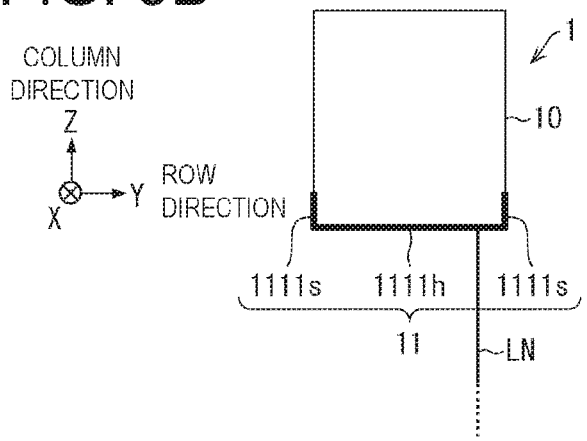
Figure 3C:
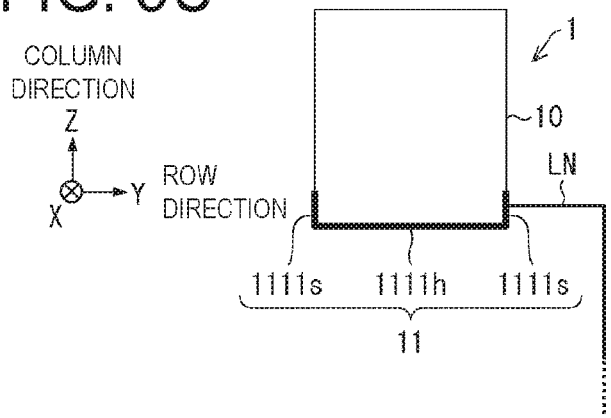

FIGS. 3A to 3C are each views for describing the edge portion 11 (lowermost edge portion). As illustrated in FIG. 3A, the edge portion 11 includes a primary end portion 1111*h* and side end portions 1111*s*.

The primary end portion 1111*f* is a portion parallel to the Y direction (second direction, row direction described later) in the edge portion 11. The side end portions 1111*s* are portions parallel to the Z direction (first direction, column direction described later) in the edge portion 11. In the display unit 10, two side end portions 1111*s* connecting to the primary end portion 1111*h* are provided on both sides of one primary end portion 1111*h*.

As illustrated in FIG. 3B, the edge portion 11 may be electrically connected to a wire LN extending in the Z direction with the primary end portion 1111*h*. The terminal 12 can be electrically connected to the wire LN extending in the Z direction by providing the primary end portion 1111*h*.

Similarly, as illustrated in FIG. 3C, the edge portion 11 may be electrically connected to the wire LN extending in the Y direction with the side end portion 1111*s*. The terminal 12 can be electrically connected to the wire LN extending in the Y direction by providing the side end portion 1111*s*.

FIG. 5A is a view schematically illustrating the configuration of the display device 1 in FIGS. 1A and 1B when viewed from the side surface. FIG. 5B is an enlarged view of an area DD1 (area including the vicinity of the lower ends of the display units 10*f* and 10*r*) of FIG. 5A. As illustrated in FIG. 5B, the terminal 12*f* is provided at the edge portion 11*f*. Specifically, the edge portion 11*f* includes a substantially U-shaped end portion (hereinafter, U-shaped end portion) that curves from the front side to the back side and from the lower side to the upper side of the display unit 10*f*. The terminal 12*f* is provided at the aforementioned end portion of the edge portion 11*f*.

The terminal 12*f* is provided as described above, which prevents the terminal 12*f* from being visually recognized by a user (user who views images displayed on the display unit 10*f*) positioned in front of the display device 1. Thus, even when the terminal 12*f* is provided, display quality of the display unit 10*f* can be maintained. A wire portion 10*f*1 to connect the terminal 12*f* with other members (in particular, a first voltage primary wiring line 191H described later and the like) is provided in the interior of the edge portion 11*f*.

As illustrated above, an edge portion 11*r* similar to the edge portion 11*f* is provided at the lower end of the display unit 10*r*. Further, the terminal 12*r* similar to the terminal 12*f* is provided at the U-shaped end portion of the edge portion 11*r*. A wire portion 10*r*1 similar to the wire portion 10*f*1 is provided in the interior of the edge portion 11*r*.

Configuration of Main Components of Display Device 1

Figure 4:
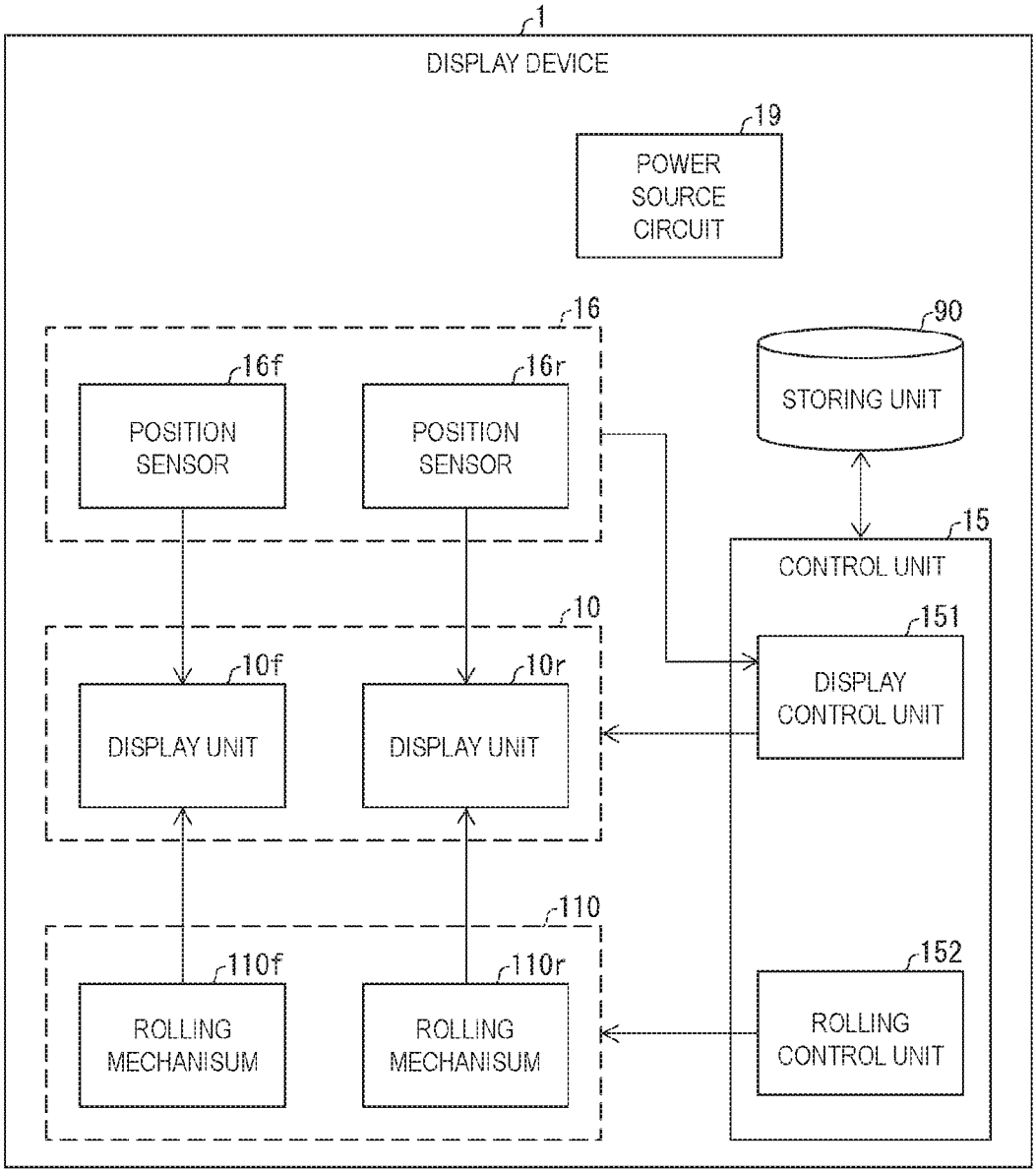
FIG. 4 is a functional block diagram illustrating a configuration of main components of the display device of FIGS. 1A and 1B.

FIG. 4 is a functional block diagram illustrating a configuration of main components of the display device 1. The display device 1 further includes a control unit 15, position sensors 16*f* and 16*r*, a power source circuit 19, and a storing unit 90. The position sensors 16*f* and 16*r* may be collectively referred to as position sensors 16.

The position sensors 16 are sensors for detecting the unrolled area of the display unit 10. For example, the position sensors 16 may be electrostatic capacitance type sensors (e.g., touch sensors) or may be optical sensors. When the optical sensor is used as the position sensor 16, a light emitting element 170 described later (electro-optic element) may be used as the light receiving element of the optical sensor.

Figure 9:
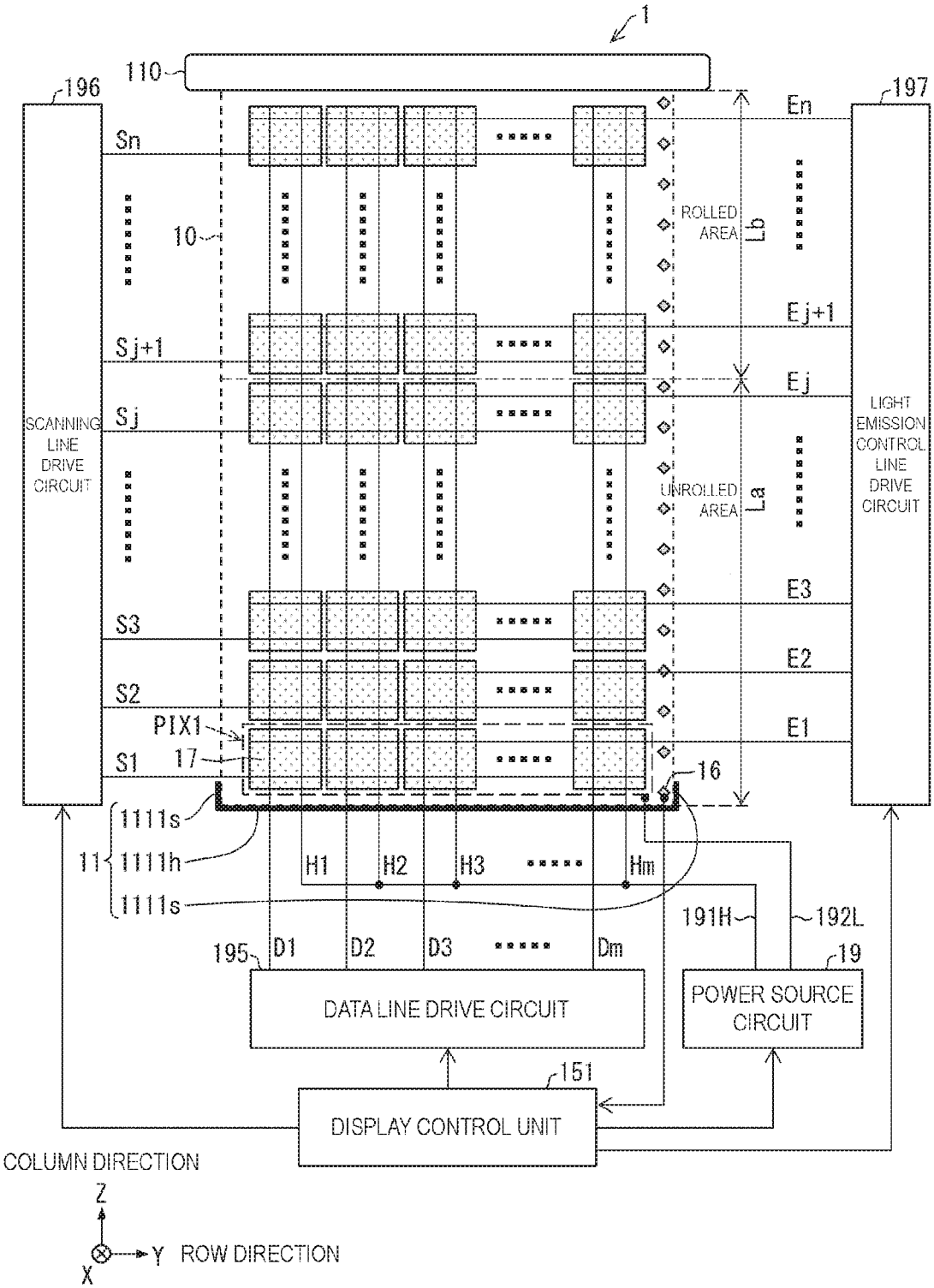
FIG. 9 is a view for describing control of voltage supply from the power source circuit to the power source circuits in the display device of FIGS. 1A and 1B.

As illustrated in FIG. 9 described later or the like, a plurality of position sensors 16 is regularly arranged along the Z direction (first direction, row direction) in the display unit 10. However, the position sensors 16 may be provided outside the display unit 10.

A power source circuit 19 supplies electric power to respective units of the display device 1. As described below, the power source circuit 19 supplies a voltage to each of a plurality of pixel circuits 17 described later.

A control unit 15 controls respective units of the display device 1 in an integrated manner. The functions of the control unit 15 may be achieved by a Central Processing Unit (CPU) executing programs stored in a storing unit 90. The storing unit 90 stores various programs to be executed by the control unit 15 and data used by a program.

The control unit 15 includes a display control unit 151 and a rolling control unit 152. The rolling control unit 152 controls the operation of the rolling mechanism 110. The rolling control unit 152, for example, may operate the driving unit of the rolling mechanism 110 in accordance with the input operation of a user to change the aforementioned length H (in other words, the length Lb). This allows the aforementioned length La to be changed to any length as desired by the user. That is, the size of the unrolled area (visually recognizable area) can be changed to any size.

Note that, it is preferable that the input operation of the user on the display device 1 is performed with wireless communications using a remote control or the like. In this case, it is not required to provide an input unit in the display device 1, and thus the designability of the display device 1 can be improved. However, an input unit may be provided in the display device 1.

The display control unit 151 controls the operation of the display unit 10. The display control unit 151 may cause the display unit 10 to display images only on the unrolled area of the display unit 10 on the basis of the detection results of the position sensors 16. An example of the display control of the display unit 10 by the display control unit 151 is described later.

Figure 6:
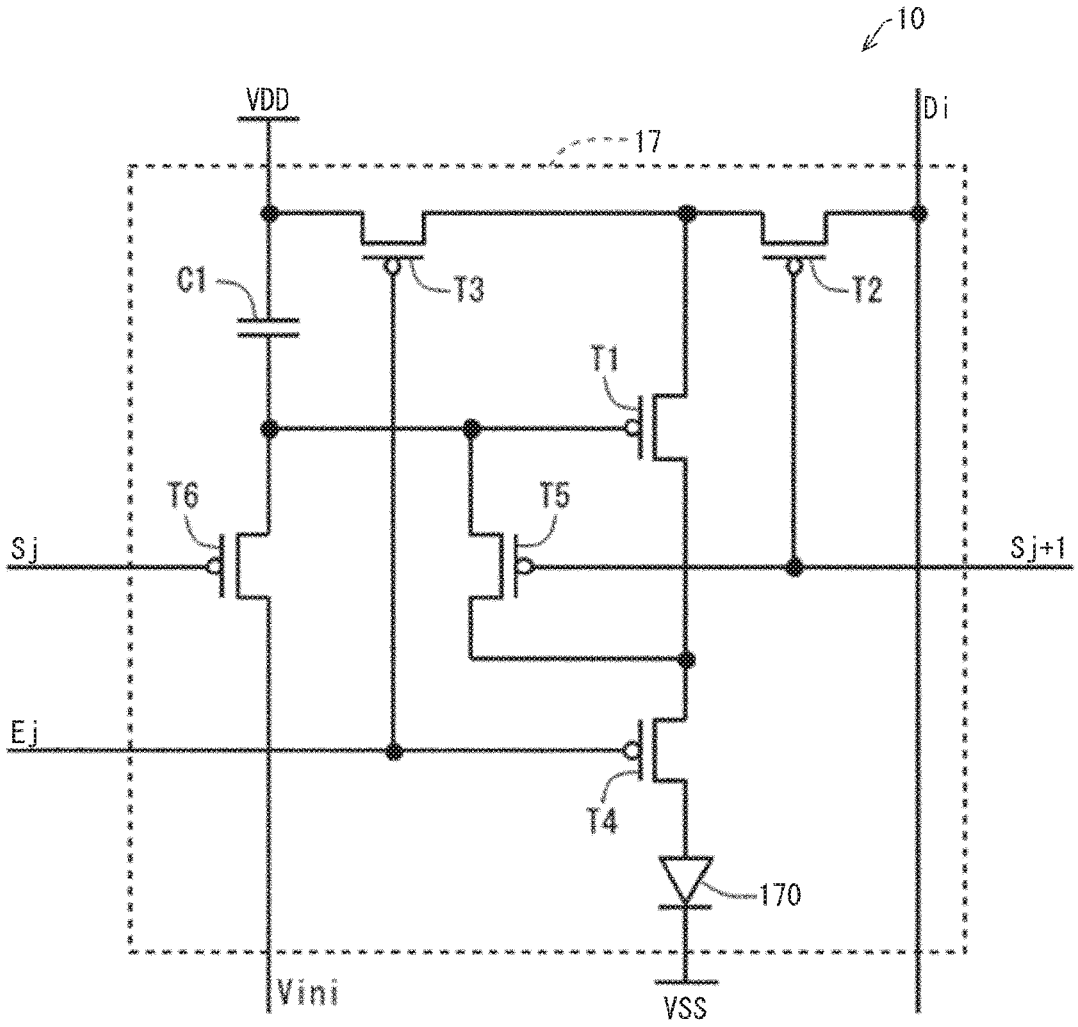
FIG. 6 is a view illustrating one example of a pixel circuit corresponding to one pixel in the display unit of FIGS. 1A and 1B.

FIG. 6 is a view illustrating one example of the pixel circuit 17 of the display unit 10. The pixel circuit 17 is a pixel circuit corresponding to one pixel of the display unit 10. A plurality of pixel circuits 17, whose number corresponds to the number of pixels of the display unit 10, is aligned in a spatially regular order in the display unit 10.

Note that other members except for the light emitting element 170, a high-level voltage terminal (terminal of electric potential VDD), and a low-level voltage terminal (terminal of electric potential VSS), which are described later, are illustrated, but the descriptions of the other members are appropriately omitted.

The pixel circuit 17 includes the light emitting element 170. The light emitting element 170 is a light source to illuminate a pixel corresponding to the pixel circuit 17. The light emitting element 170 is an electro-optic element in which luminance or transmissivity is controlled by a current. An example of a current-control-type electro-optic element includes Organic Light Emitting Diode (OLED), an inorganic light emitting diode, or Quantum dot Light Emitting Diode (QLED).

For example, the OLED includes a first electrode (e.g., positive electrode), a second electrode (e.g., negative electrode) formed on the first electrode, and a light emitting layer between the first electrode and the second electrode). A voltage that is equal to or higher than a threshold value of the light emitting layer is applied between the first electrode and the second electrode to pass a drive current (active current) through the light emitting layer, thereby causing the light emitting layer to emit light.

Accordingly, the display device is not particularly limited as long as the display unit 10 has flexibility and includes a bendable light emitting element 170 (electro-optic element). The display unit 10 may be an organic Electro Luminescence (EL) display including the OLED or may be an inorganic EL display including the inorganic light emitting diode. As described above, the display unit 10 may be a known EL display. Alternatively, the display unit 10 may be a QLED display including a QLED.

In FIG. 6, Di denotes an i-th (i: an integer) data signal wiring line in the display unit 10 (see FIG. 9 described later). Sj and Sj+1 are j-th (j: an integer) and j+1-th scanning wiring lines of the display unit 10. Further, Ej is a j-th light emission control wiring line of the display unit 10. The light emission control wiring line Ej is provided corresponding one-to-one to a scanning wiring line Sj (see FIG. 9).

T1 to T6 in FIG. 6 denote Thin Film Transistors (TFTs). The T1 to T6 may be used as switching elements. As illustrated in FIG. 6, the gates of T3 and T4 are connected to the light emission control wiring line Ej. Similarly, the gates of T2 and T5 are connected to the scanning wiring line Sj+1. Similarly, the gate of T6 is connected to the scanning wiring line Sj.

When a scanning signal is inputted to the scanning wiring line Sj, the scanning signal is applied to the gate of T6, thereby bringing T6 into an ON (conduction) state. Similarly, when a scanning signal is inputted to the scanning wiring line Sj+1, the scanning signal is applied to the gates of T2 and T5, thereby bringing T2 and T5 into an ON state. When a control signal is inputted to the light emission control wiring line Ej, the scanning signal is applied to the gate of T4, thereby bringing T4 into an ON state.

A data signal (analog voltage signal) corresponding to an image displayed on the display unit 10 is inputted to a data signal wiring line Di. The data signal from the data signal wiring line Di is inputted to the pixel circuit 17 via T2.

The anode of the light emitting element 170 is electrically connected to the high-level voltage terminal via T3, T1, and T4. Similarly, the cathode of the light emitting element 170 is electrically connected to the low-level voltage terminal. When a voltage (potential difference) between the anode and the cathode of the light emitting element 170 is represented as VP, VP=VDD−VSS.

The high-level voltage terminal is connected to a first voltage primary wiring line 191H described later via the terminal 12. A voltage VDD is applied from the power source circuit 19 to the first voltage primary wiring line 191H as a first voltage. The voltage VDD may be constant voltage, for example, from 5 V to 10 V.

Figure 7:
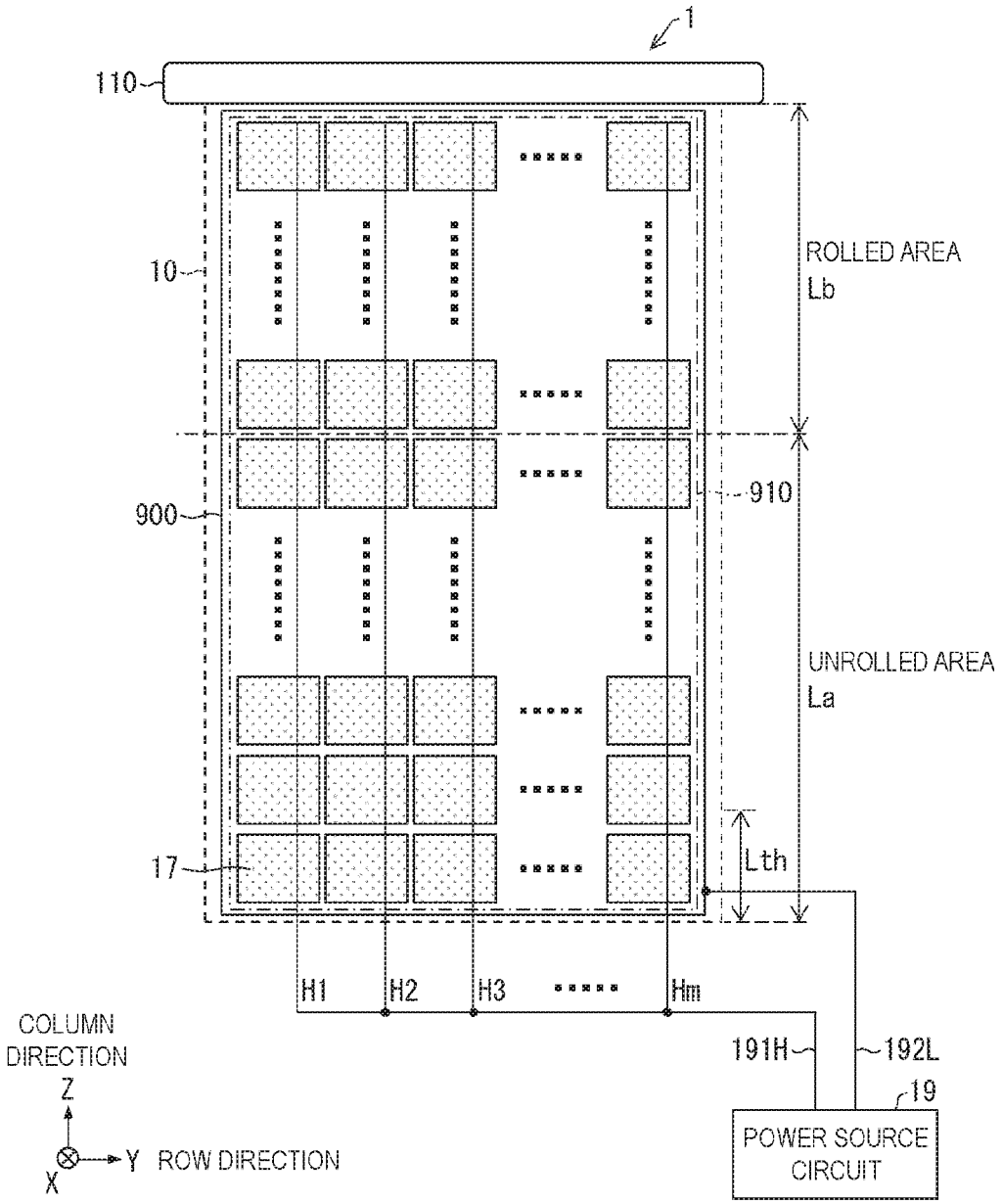
FIG. 7 is a view for describing a configuration to supply a voltage from a power source circuit to pixel circuits in the display device of FIGS. 1A and 1B.

The low-level voltage terminal is electrically connected to the second electrode (negative electrode) of the pixel circuit 17. The negative electrode may be an integrated electrode (so called solid electrode) that is commonly used for the plurality of pixel circuits 17 (at least two pixel circuits 17). As illustrated in FIG. 7 described later, an electrode 900 may be formed as the solid electrode to cover all the light emitting elements 170.

As illustrated in FIG. 7, the electrode 900 may be connected to a second voltage primary wiring line 192L described later in the edge portion 11. A voltage VSS is applied from the power source circuit 19 to the second voltage primary wiring line 192L as a second voltage. The second voltage is set to a voltage lower than the first voltage. The voltage VSS may be constant voltage, for example, from −5V to 5V.

When a scanning signal is inputted to the scanning wiring lines Sj and Sj+1, a control signal is inputted to the light emission control wiring line Ej, and a data signal is inputted to the data signal wiring line Di (hereinafter, illumination condition), the TFTs T1 to T6 are put into an ON state. That is, the voltage VDD can be supplied from the high-level voltage terminal to the anode of the light emitting element 170. Thus, a drive current to cause (drive) the light emitting element 170 to emit light can be supplied from the high-level voltage terminal to the light emitting element 170.

In contrast, when the aforementioned illumination condition is not satisfied, the supply of the voltage VDD from the high-level voltage terminal to the anode of the light emitting element 170 can be stopped. Thus, the drive current does not flow. As described above, according to the pixel circuits 17, the drive (generation or no generation of the drive current) of the light emitting element 170 can be selectively switched.

Configuration to Supply Voltage from Power Source Circuit to Pixel Circuit

FIG. 7 is a view for describing the configuration to supply voltage (first voltage, second voltage) from the power source circuit 19 to each of the plurality of pixel circuits 17. In FIG. 7, for the convenience of description, the unrolled area of the display unit 10 is illustrated in an expanded state. In this respect, the same is applied to FIG. 9 described later.

The display device 1 includes (i) the first voltage primary wiring line 191H that supplies the first voltage from the power source circuit 19 to the respective pixel circuits 17, and (ii) the second voltage primary wiring line 192L that supplies the second voltage from the power source circuit 19 to the respective pixel circuits 17.

As illustrated in FIG. 7, the aforementioned electrode 900 (negative electrode, second electrode) is electrically connected to the second voltage primary wiring line 192L at the lowermost edge portion (the aforementioned edge portion 11) of the rolled area. More specifically, the second voltage primary wiring line 192L is electrically connected to a connection portion 910 which is a wire of a TFT layer electrically connected with the electrode 900.

Figure 8:
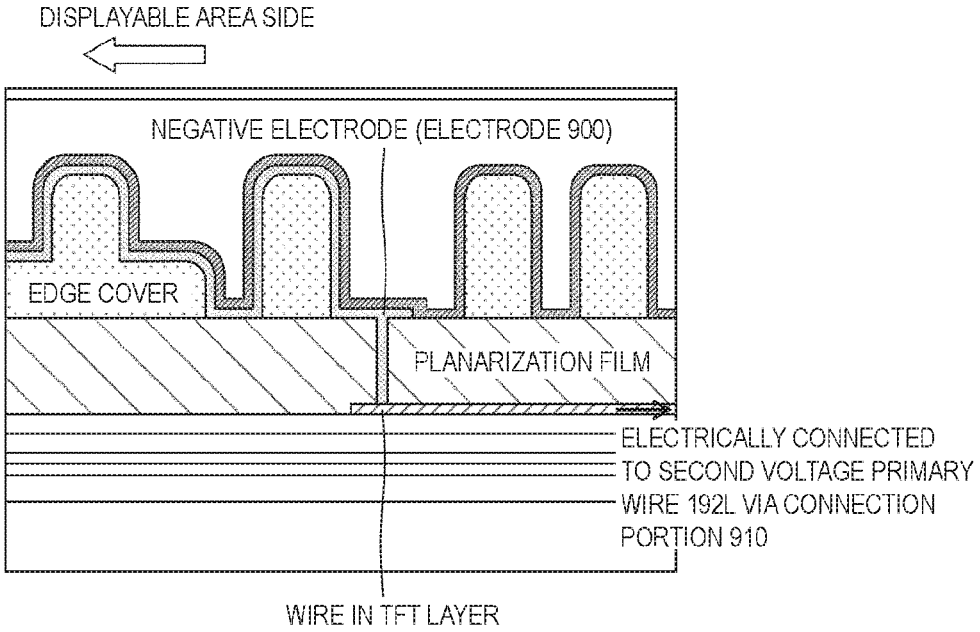
FIG. 8 is a cross-sectional view schematically illustrating a configuration of electrically connecting a negative electrode and a second voltage primary wiring line in the display device of FIGS. 1A and 1B.

FIG. 8 is a cross-sectional view schematically illustrating the configuration of electrically connecting the electrode 900 and the second voltage primary wiring line 192L. As illustrated in FIG. 8, the electrode 900 is electrically connected to the second voltage primary wiring line 192L via a wire (for example, the connection portion 910) formed on the TFT layer. Note that the TFT layer, for example, is a layer on which the aforementioned TFTs T1 to T6 are provided, out of the layers of the display unit 10. Besides the TFTs T1 to T6, more TFTs (switching element) may be provided on the TFT layer.

FIG. 7 or the like is illustrated as if the connection portion 910 was not provided at the end portion of the display unit 10 on the side of the rolling mechanism 110. However, the connection portion 910 may be formed on part or whole of the end portion along the end portion of the display unit 10 on the side of the rolling mechanism 110.

The second voltage primary wiring line 192L may be electrically connected to the connection portion 910 via the side end portion 1111*s* of the edge portion 11 (see also FIG. 3C). However, as illustrated in FIG. 9 described later or the like, the second voltage primary wiring line 192L may be electrically connected to the connection portion 910 via the primary end portion huh of the edge portion 11 (see also FIG. 3B).

The display device 1 includes a plurality of first voltage wiring lines H1 to Hm extending from the first voltage primary wiring line 191H to the respective plurality of pixel circuits 17. The first voltage wiring lines H1 to Hm are provided corresponding one-to-one to data signal wiring lines D1 to Dm illustrated in FIG. 7 described later.

In FIG. 7, the first voltage wiring line H1 and the data signal wiring line D1 are respectively a first voltage wiring line and a data signal wiring line positioned at the left end of the display unit 10. Similarly, the first voltage wiring line Hm and the data signal wiring line Dm are respectively a first voltage wiring line and a data signal wiring line positioned at the right end of the display unit 10. The first voltage wiring line and the data signal wiring line are numbered such that the number is increased one by one from the left side to the right side of the sheet of FIG. 7 (in the positive Y direction).

Similar to the data signal wiring lines D1 to Dm, the first voltage wiring lines H1 to Hm extend in the Z direction (first direction, a direction parallel to the direction in which the display unit 10 is drawn out from the rolling mechanism 110) and are provided parallel to each other along the Y direction (second direction, a direction intersecting with the first direction).

In the first embodiment, the column direction of the display unit 10 is the Z direction, and the row direction of the display unit 10 is the Y direction. The first voltage primary wiring line 191H supplies the first voltage to the respective pixel circuits 17 via the plurality of first voltage wiring lines H1 to Hm. Note that in the display unit 10, the respective pixel circuits 17 are regularly arranged in a matrix form along the Z direction and the Y direction. It is to be understood that the aforementioned letter m represents the number of pixels in the horizontal direction of the display unit 10. Similarly, it is to be understood that a letter n described below represents the number of pixels in the vertical direction of the display unit 10.

As illustrated in FIG. 7, the respective pixel circuits 17 positioned on the same column (e.g., the first column) are connected in series to one first voltage wiring line (e.g., the first voltage wiring line H1) corresponding to the column. Thus, for example, the pixel circuit 17 (the pixel circuit 17 positioned in the first row) positioned at the lowermost edge portion, out of the plurality of pixel circuits 17 positioned in the first column, is electrically connected to the first voltage wiring line H1 first.

Herein, "the pixel circuit 17 positioned at the lowermost edge portion is electrically connected to the first voltage wiring line H1 first" means that the pixel circuit 17 positioned at the end portion (strictly speaking, the pixel circuit 17 contributed to the light emission of the display unit 10) is connected to the first voltage wiring line H1 without connecting with other pixel circuits 17 (pixel circuits positioned in the second row onward).

However, when a predetermined threshold-value length Lth is determined with respect to the displayable area (active area) of the display unit 10, "the pixel circuit 17 positioned at the lowermost edge portion is electrically connected to the first voltage wiring line H1 first" means that the pixel circuit 17 positioned in a range of the threshold-value length Lth from the lowermost edge portion is electrically connected to the first voltage wiring line H1. Hereinafter, the same is applied to words "electrically connected first" used in other descriptions.

Note that the threshold-value length Lth is a threshold value of the aforementioned length La (exposure length). When the display unit 10 is drawn out from the rolling mechanism 110 by less than threshold-value length Lth, the display control unit 151 may carry out control such as not to illuminate the unrolled area of the display unit 10 even in the case where the display unit 10 is drawn out from the rolling mechanism 110. In the case where the threshold-value length Lth is determined, when the display unit 10 is drawn out from the rolling mechanism 110 by the threshold-value length Lth or longer, the display control unit 151 may carry out control to illuminate the unrolled area of the display unit 10.

As described above, in the display device 1, the first voltage primary wiring line 191H is electrically connected to the pixel circuits 17 positioned at the lowermost edge portion first, out of the plurality of pixel circuits 17 (via the first voltage wiring lines H1 to Hm). Note that a group of pixel circuits 17 positioned at the lowermost edge portion is illustrated as PIX1 in FIG. 9 described below.

Alternatively, in the display device in accordance with an aspect of the disclosure, the second voltage primary wiring line 192L may be provided electrically connected with the pixel circuits 17 positioned at the lowermost edge portion first, out of the plurality of pixel circuits 17. That is, the display device in accordance with an aspect of the disclosure may be configured such that at least one of the first voltage primary wiring line 191H and the second voltage primary wiring line 192L is electrically connected with the pixel circuits 17 positioned at the lowermost edge portion first, out of the plurality of pixel circuits 17.

Note that the display unit 10 may include pixel circuits (dummy pixel circuits) in which the light emitting element is not provided, besides the pixel circuits 17 (hereinafter, light emitting pixel circuits) including the pixel circuit 170. In this case, at least one of the first voltage primary wiring line 191H and the second voltage primary wiring line 192L may be electrically connected to the light emitting pixel circuit nearest to the lowermost edge portion first, out of the plurality of light emitting pixel circuits. Note that, in the explanation of the present Description, "electrically connected" is also simply referred to as "connected".

Configuration to Control Supply of Voltage from Power Source Circuit to Pixel Circuit FIG. 9 is a view for describing control of voltage supply from the power source circuit 19 to the power source circuits 17. As illustrated in FIG. 9, the display device 1 includes a data signal wiring line drive circuit 195 for driving the data signal wiring lines D1 to Dm (supplying the data signals to the data signal wiring lines D1 to Dm), a scanning wiring line drive circuit 196 for driving the scanning wiring lines S1 to Sn (supplying the scanning signals to the scanning wiring lines S1 to Sn), and a light emission control wiring line drive circuit 197 for driving the light emission control wiring lines E1 to En (supplying the control signals to the light emission control wiring lines E1 to En). Each of the data signal wiring line drive circuit 195, the scanning wiring line drive circuit 196, and the light emission control wiring line drive circuit 197 is controlled by the display control unit 151.

In FIG. 9, the scanning wiring line S1 and the light emission control wiring line E1 are the scanning wiring line and the light emission control wiring line positioned at the lower end of the display unit 10, respectively. Similarly, the scanning wiring line Sn and the light emission control wiring line En are the scanning wiring line and the light emission control wiring line positioned at the upper end of the display unit 10, respectively. The scanning wiring lines and the light emission control wiring lines are numbered such that the number is increased one by one from the lower side to the upper side of the sheet of FIG. 9 (in the positive Z direction). In this way, the light emission control wiring lines E1 to En are provided corresponding one-to-one to the scanning wiring lines S1 to Sn.

As illustrated in FIG. 9, the scanning wiring lines S1 to Sj and the light emission control wiring lines E1 to Ej correspond to the respective pixel circuits 17 included in the rolled area. Similarly, the scanning wiring lines Sj+1 to Sn and the light emission control wiring lines Ej+1 to En correspond to the respective pixel circuits 17 included in the unrolled area.

As described above, the plurality of position sensors 16 are regularly arranged along the Z direction in the display unit 10. Each of the rolled area and the unrolled area can be detected on the basis of the detection results of the position sensors 16. For example, the display control unit 151 may obtain the detection results of the position sensors 16 and carry out the aforementioned detection (determination).

For example, in the case where the position sensors 16 are optical sensors, when one position sensor 16 detects light which has an intensity equal to or higher than a predetermined value, it may be determined that a position at which the position sensor 16 is provided is in the unrolled area. In contrast, when one position sensor 16 detects light which has an intensity less than a predetermined value, it may be determined that a position at which the position sensor 16 is provided is in the rolled area.

The scanning wiring lines S1 to Sn and the light emission control wiring lines E1 to Ej intersect with the data signal wiring lines D1 to Dm. The scanning wiring lines S1 to Sn and the light emission control wiring lines E1 to Ej extend to the plurality of pixel circuits 17 in the Y direction (second direction) and are aligned along the Z direction (first direction).

The display control unit 151 may control to cause the display unit 10 to display images only on the unrolled area and prevent the display unit 10 from displaying the images on the rolled area. More specifically, the display control unit 151 may control the data signal wiring line drive circuit 195 and the scanning wiring line drive circuit 196 to cause only the light emitting elements 170 provided in the pixel circuits 17 included in the unrolled area to emit light (pass the drive current through only the light emitting elements 170).

This control can prevent the light emitting elements 170 provided in the pixel circuits 17 included in the rolled area from emitting light (prevent the drive current from passing through the light emitting elements 170). For example, the display control unit 151 may perform the control of at least any of (1) to (3) described below.

(1) The display control unit 151 may control the scanning wiring line drive circuit 196 and input the scanning signals only to the scanning wiring lines S1 to Sj corresponding to the pixel circuits 17 included in the unrolled area, out of the scanning wiring lines S1 to Sn. This prevents the scanning signals from being inputted to the scanning wiring lines Sj+1 to Sn corresponding to the pixel circuits 17 included in the rolled area, out of the scanning wiring lines S1 to Sn. Thus, images can be displayed only on the unrolled area.

(2) The display control unit 151 may control the light emission control wiring line drive circuit 197 and input the control signals only to the light emission control wiring lines E1 to Ej corresponding to the pixel circuits 17 included in the unrolled area, out of the light emission control wiring lines E1 to En. This prevents the control signals from being inputted to the light emission control wiring lines Ej+1 to En corresponding to the pixel circuits 17 included in the rolled area, out of the light emission control wiring lines E1 to En. Thus, images can be displayed only on the unrolled area.

(3) The display control unit 151 may control the data signal wiring line drive circuit 195 and input the data signals only to the pixel circuits 17 included in the unrolled area. This prevents the data signals from being inputted to the pixel circuits 17 included in the rolled area. Thus, images can be displayed only on the unrolled area.

As described above, the display control unit 151 can determine target pixel circuits 17 to which the signals are inputted, out of the plurality of pixel circuits 17 on the basis of the detection results of the position sensors 16. Note that "the signals" herein may include any signal. For example, the signals include the data signal, the scanning signal, and the control signal.

Note that the magnitude of a voltage (the intensity of a signal) applied to the scanning wiring lines S1 to Sn and the light emission control wiring lines E1 to En is typically larger than the magnitude of a voltage applied to the data signal wiring lines D1 to Dm. As one example, the magnitude of a voltage applied to the scanning wiring lines S1 to Sn and the light emission control wiring lines E1 to En is from 10 V to 20 V. Similarly, the magnitude of a voltage applied to the data signal wiring lines D1 to Dm is from 2 V to 5 V.

Further, parasitic capacitance and resistance that are unintended in the process of designing are present in the wire of the display unit 10, and when the aforementioned voltage is applied, a minute current (passive current) flows due to the voltage. Then, this minute current may generate heat in the display unit 10.

Thus, it is preferable that the scanning wiring lines S1 to Sn and the light emission control wiring lines E1 to En (the signal lines to which a high voltage is applied) are provided extending in the Y direction (second direction, row direction) to efficiently prevent generation of heat in the unrolled area of the display unit 10. Similarly, it is preferable that the data signal wiring lines D1 to Dm are provided extending in the Z direction (first direction, column direction).

One Example of Display Control with Display Control Unit 151

Figure 10A:
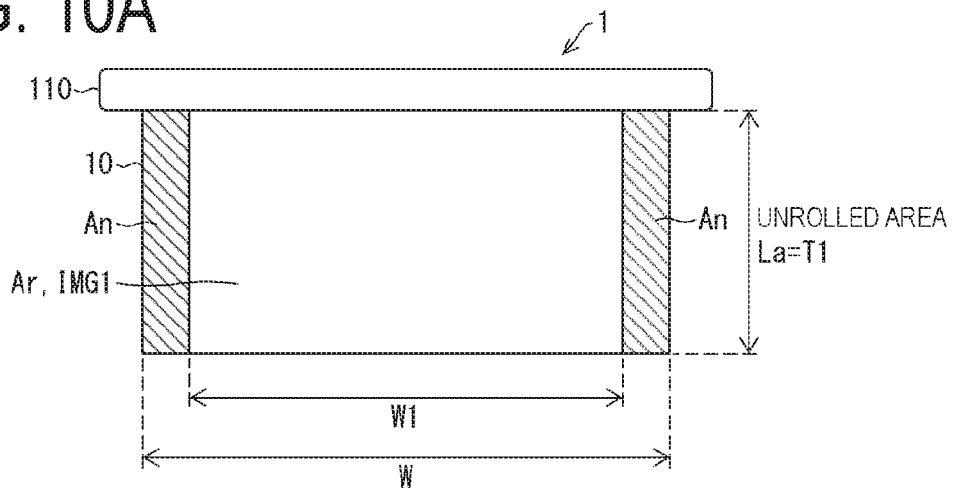
FIGS. 10A and 10B are views illustrating one example of display control with the display device of FIGS. 1A and 1B.
Figure 10B:
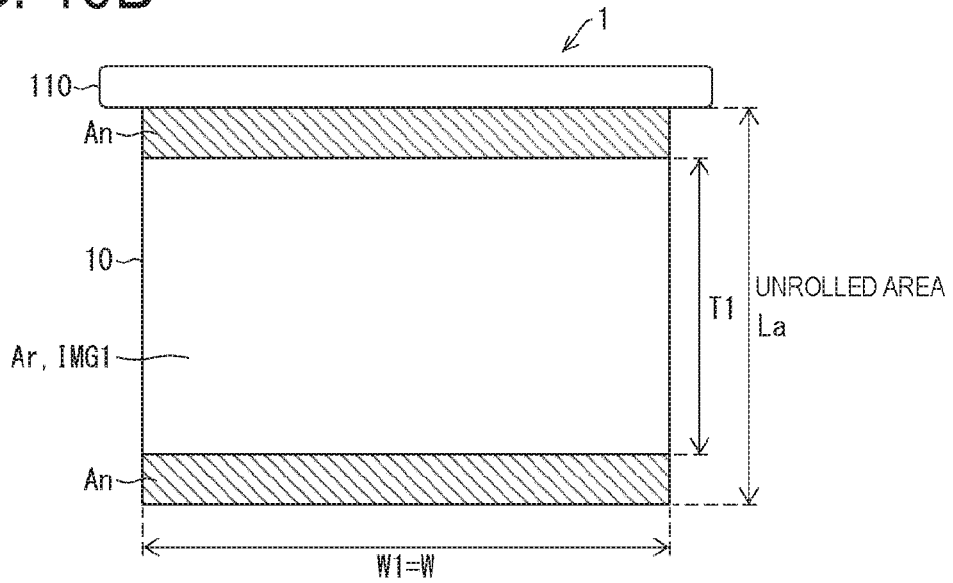

FIGS. 10A and 10B are views illustrating one example of display control of the display control unit 151. The display control unit 151 may set a section (hereinafter, a display section Ar) for displaying an image IMG1 on the unrolled area on the basis of the length of the unrolled area and an aspect ratio of the image IMG1 to be displayed on the display unit 10. Note that sections on which the image IMG1 is not displayed in the unrolled area are referred to as non-display sections An.

As one example, it is assumed that the aspect ratio of the image IMG1 is represented as lateral length:longitudinal length=16:9. That is, when a length in the lateral direction of the image IMG1 is represented as w1 and a length in the longitudinal direction of the image IMG1 is represented as t1, w1:t1=16:9. However, the aspect ratio of the image IMG1 may be set to any ratio. Note that the longitudinal direction (vertical direction) and the lateral direction (horizontal direction) of the image IMG1 are set in advance.

Herein, a length in the lateral direction of the display unit 10 is represented as W1. As illustrated in FIG. 10A, when the length La of the unrolled area is relatively short, the display control unit 151 may set the display section Ar to the entire unrolled area in the up-and-down direction. That is, the display control unit 151 may reduce the size of the image IMG1 to display the image IMG1 while maintaining the aspect ratio of the image IMG1. In this case, the length w1 in the lateral direction of the image IMG1 is set to be shorter than a length W.

FIG. 10A exemplifies a case where the display section Ar is set in the center in the lateral direction of the unrolled area, and the non-display sections An are set on both ends in the lateral direction of the unrolled area (sections excluding the display section Ar in the unrolled area). However, the display section Ar may be set to any position. For example, in FIG. 10A, the display section Ar may be set to be abutting to the left end or the right end of the unrolled area.

Further, as illustrated in FIG. 10B, when the length La of the unrolled area is relatively long, the display control unit 151 may set the length w1 in the lateral direction of the image IMG1 to be equal to the length W while maintaining the aspect ratio of the image IMG1. In this case, the length t1 in the longitudinal direction of the image IMG1 may be set to be shorter than the length La of the unrolled area.

FIG. 10B exemplifies a case where the display section Ar is set in the center in the longitudinal direction of the unrolled area, and the non-display sections An are set on both ends in the longitudinal direction of the unrolled area (sections excluding the display section Ar in the unrolled area). However, as described above, the display section Ar may be set abutting to the upper end or the lower end of the unrolled area.

As described above, the display of the image IMG1 can be changed in accordance with the length of the unrolled area by setting the display section Ar while maintaining the aspect ratio of the image IMG1, so that display quality for the user can be enhanced.

Effects of Display Device 1

In accordance with the display device 1, images can be displayed only on the unrolled area of the display unit 10. More specifically, only the light emitting elements 170 provided in the pixel circuits 17 included in the unrolled area can emit light (the drive current can be passed through the light emitting elements 170).

That is, the light emitting elements 170 provided in the pixel circuits 17 included in the rolled area (an area having a small heat dissipation area, compared with the unrolled area) can be prevented from emitting light (the drive current is prevented from passing through the light emitting elements 170).

In particular, in the display device 1, the terminal 12 is provided at the edge portion 11 of the display unit 10. Accordingly, the first voltage primary wiring line 191H is connected to the pixel circuits 17 arranged at the edge portion 11 first. Thus, the aforementioned drive current first flows into the pixel circuits 17 arranged at the edge portion 11 via the first voltage primary wiring line 191H.

Consequently, when images are displayed only on the unrolled area of the display unit 10, the drive current can be passed through only the pixel circuits 17 included in the unrolled area without passing through the pixel circuits 17 included in the rolled area.

As a result, a Joule's heat attributed to the drive current can be prevented from generating in the rolled area. Consequently, an increase in the temperature of the rolled area can be prevented, and the deterioration of the display device 1 due to the increase in the temperature of the rolled area can be prevented.

Modification

Figure 11:
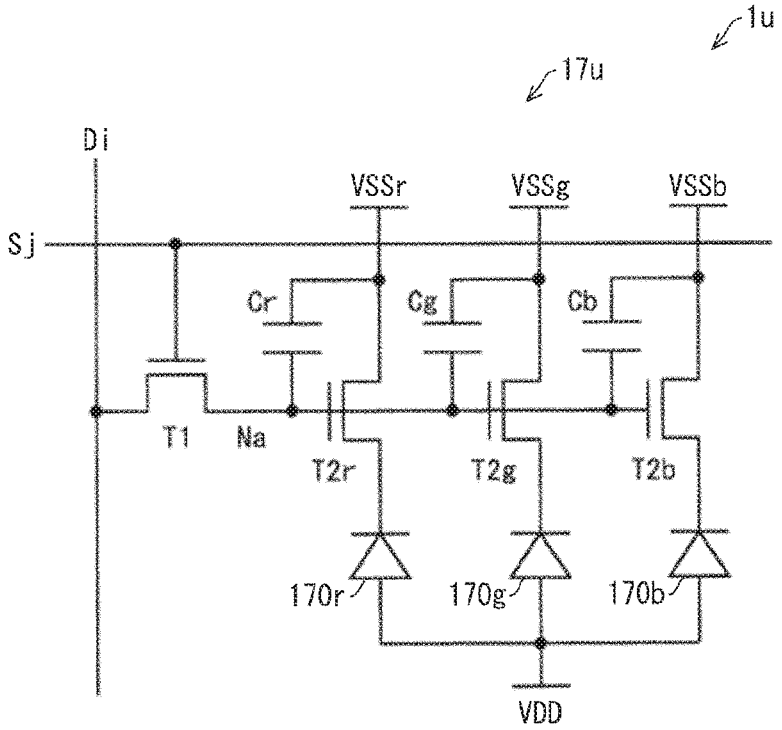
FIG. 11 is a view illustrating one modification of the display device of FIGS. 1A and 1B and illustrating another example of the pixel circuit.

Hereinafter, a display device 1*u* will be described with reference to FIG. 11 as one modification of the display device 1. As illustrated in FIG. 11, the display device 1*u* includes a pixel circuit 17*u*. The pixel circuit 17*u* is one modification of the aforementioned pixel circuit 17.

The pixel circuit 17*u* includes a light emitting element 170*r* for emitting red (Red) light, a light emitting element 170*g* for emitting green (Green) light, and a light emitting element 170*b* for emitting blue (Blue) light. The light emitting elements 170*r*, 170*g*, and 170*b* are electro-optic elements similar to the light emitting elements 170 described above.

The anodes of the light emitting elements 170*r*, 170*g*, and 170*b* are connected to a common high-level voltage terminal (electric potential: VDD). The common high-level voltage terminal, for example, may be connected to the aforementioned electrode 900 (solid electrode).

On the other hand, respective cathodes of the light emitting elements 170*r*, 170*g*, and 170*b* are connected to individual high-level voltage terminals. Specifically, the cathode of the light emitting element 170*r* is connected to a first low-level voltage terminal (electric potential; Vssr) via a TFT T2*r*, and the cathode of the light emitting element 170*g* is connected to a second low-level voltage terminal (electric potential: Vssg) via a TFT T2*g*, and the cathode of the light emitting element 170*b* is connected to a third low-level voltage terminal (electric potential: Vssb) via a TFT T2*b*. The voltages Vssr, Vssg, and Vssb correspond to the aforementioned second voltage.

As described above, in the display device in accordance with an aspect of the disclosure, at least one of the first voltage primary wiring line 191H and the second voltage primary wiring line 192L is electrically connected with the pixel circuits 17 arranged at the lowermost edge portion first, out of the plurality of pixel circuits 17. Thus, the display device 1*u* including the pixel circuits 17*u* has the same effects as those of the display device 1.

Modification

Figure 12A:
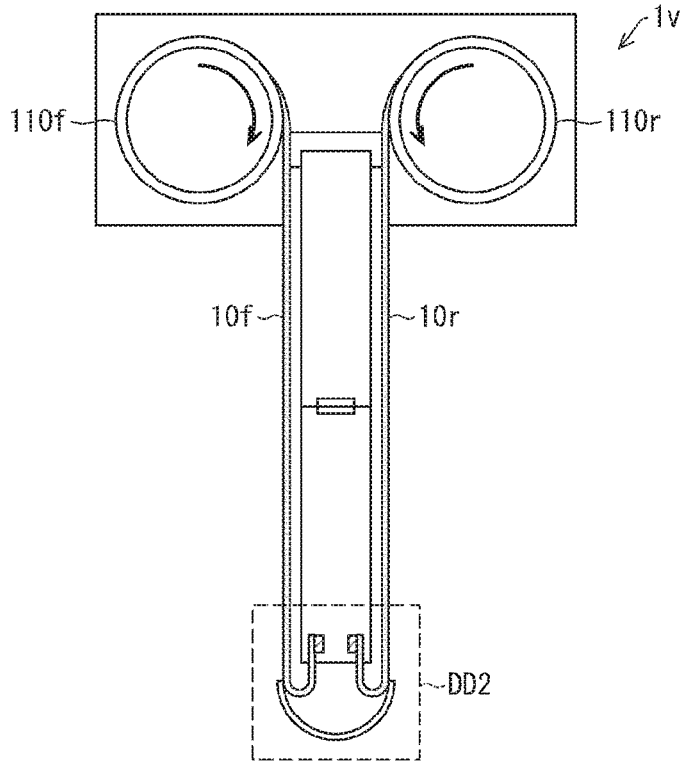
FIG. 12A is a schematic side view of the display device as another modification of the display device of FIGS. 1A and 1B.
Figure 12B:
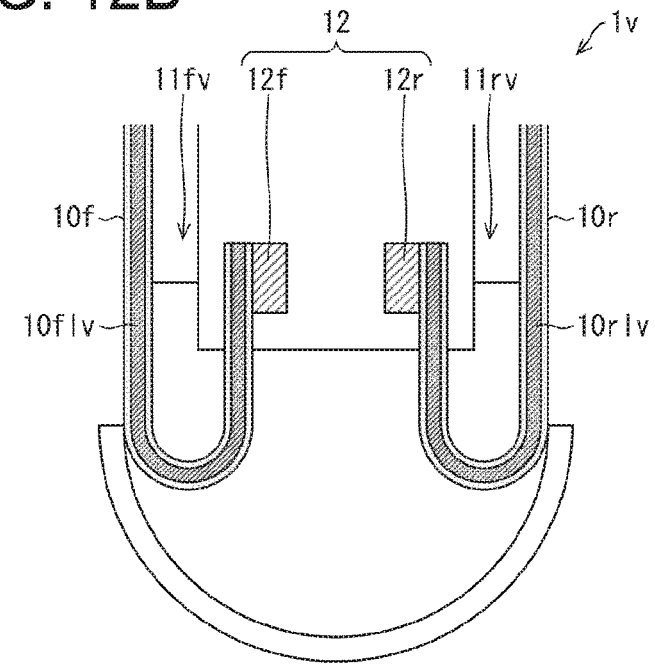
FIG. 12B is an enlarged view of an area DD2 in FIG. 12A.

Hereinafter, a display device 1*v* will be described with reference to FIGS. 12A and 12B as another modification of the display device 1. FIG. 12A is a schematic side view of the display device 1*v*. FIG. 12B is an enlarged view of an area DD2 (area including the vicinity of the lower ends of the display units 10*f* and 10*r*) of FIG. 12A.

Note that the edge portions of the display device 1*v* are referred to as edge portions 11*fv* and 11*rv*, and the wire portions of the display device 1*v* are referred to as wire portions 10*flv* and 10*rlv* to be distinguished from the edge portions 11*f* and 11*r* and the wire portions 10*f*1 and 10*r*1 of the display device 1.

As illustrated in FIGS. 12A and 12B, U-shaped end portions are formed in the edge portions 11*fv* and 11*rv* substantially along an arc. That is, the edge portions 11*fv* and 11*rv* are configured such that the curvature of the edge portions 11*fv* and 11*rv* (in particular, the U-shaped end portions) smoothly (consecutively) changes. Stress can be prevented from concentrating on parts (in particular, parts of the U-shaped end portions) of the edge portions 11*fv* and 11*rv* by smoothly changing the curvature of the edge portions 11*fv* and 11*rv*. Consequently, damage of the terminal 12 and the wires in the vicinity of the terminal 12 can be prevented. As a result, the reliability of the display device 1*v* can be improved.

Second Embodiment

Figure 13A:
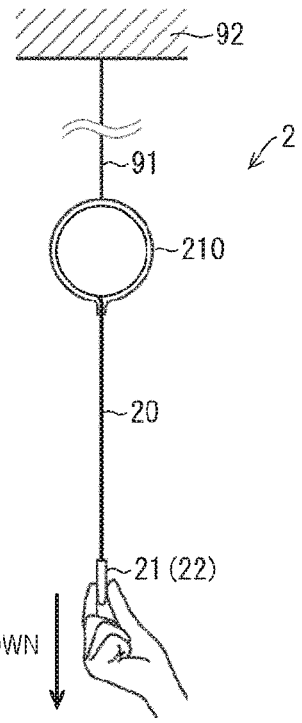
FIG. 13A is a view schematically illustrating a configuration of a display device of a second embodiment.
Figure 13B:
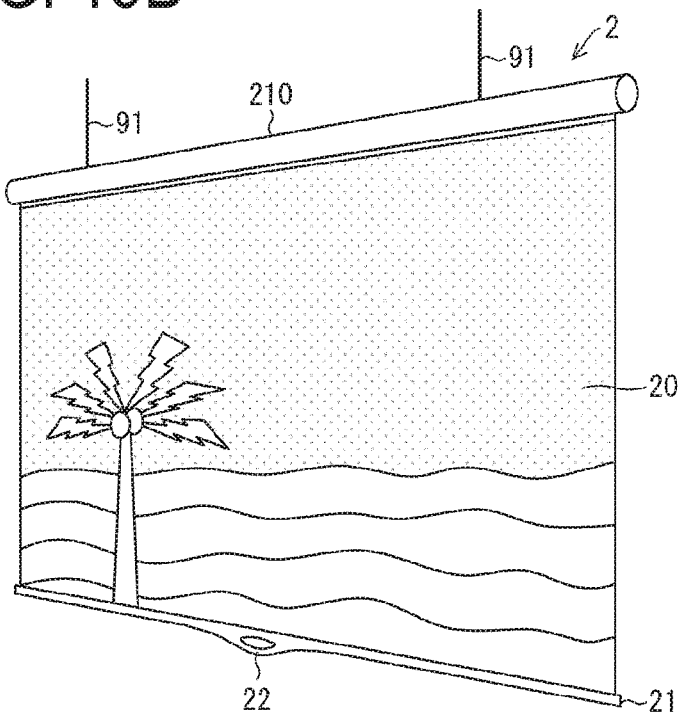
FIG. 13B is a view schematically illustrating a configuration of a display unit and its periphery in the display device.

A description follows regarding the second embodiment of the disclosure with reference to FIGS. 13A and 13B. Note that, for the convenience of description, members having the same function as the components stated in the aforementioned embodiment are appended with the same reference signs, and the description thereof is omitted.

FIG. 13A is a view schematically illustrating the configuration of a display device 2 of the second embodiment. The display device 2 includes only one display unit 20, in place of the two display units 10*f* and 10*r*. That is, the display device 2 is different from the display device 1, for example, in that the display device 2 is configured as a single-sided signage. The display device 2 is one example of the display device of which the configuration is simplified, compared with the display device 1.

Furthermore, the display device 2 includes a rolling mechanism 210 (rolling mechanism), in place of the rolling mechanism 110 of the display device 1. The rolling mechanism 210 is a mechanism in which the user manually roll up or roll down the display unit 20. The configuration of the rolling mechanism 210 is similar to known configuration, and its description is omitted accordingly. In the display device 2, the rolling control unit 152 of the display device 1 can be omitted.

FIG. 13B is a view schematically illustrating the configuration of the display unit 20 and its vicinity. The rolling mechanism 210 is suspended from a ceiling 92, for example, with two supporting lines 91. Note that the edge portion of the display unit 20 is referred to as an edge portion 21. The edge portion 21 is different from the edge portion 11 in that the edge portion 21 includes a holding part 22.

An opening is formed on the front side of the holding part 22 (the front side of the display unit 20). The user can grip the holding part 22, for example, with two fingers through the opening of the holding part 22. Then, the user lowers his/her hand downward while gripping the holding part 22, thereby pulling down (rolling down) the display unit 20.

In the display device 2 also, as is the same with the display device 1, a current I can be passed through only the unrolled area of the display unit 20 on the basis of the detection results of the position sensors 16. Consequently, the display device 20 has the same effect as that of the display device 1.

Third Embodiment

Figure 14:
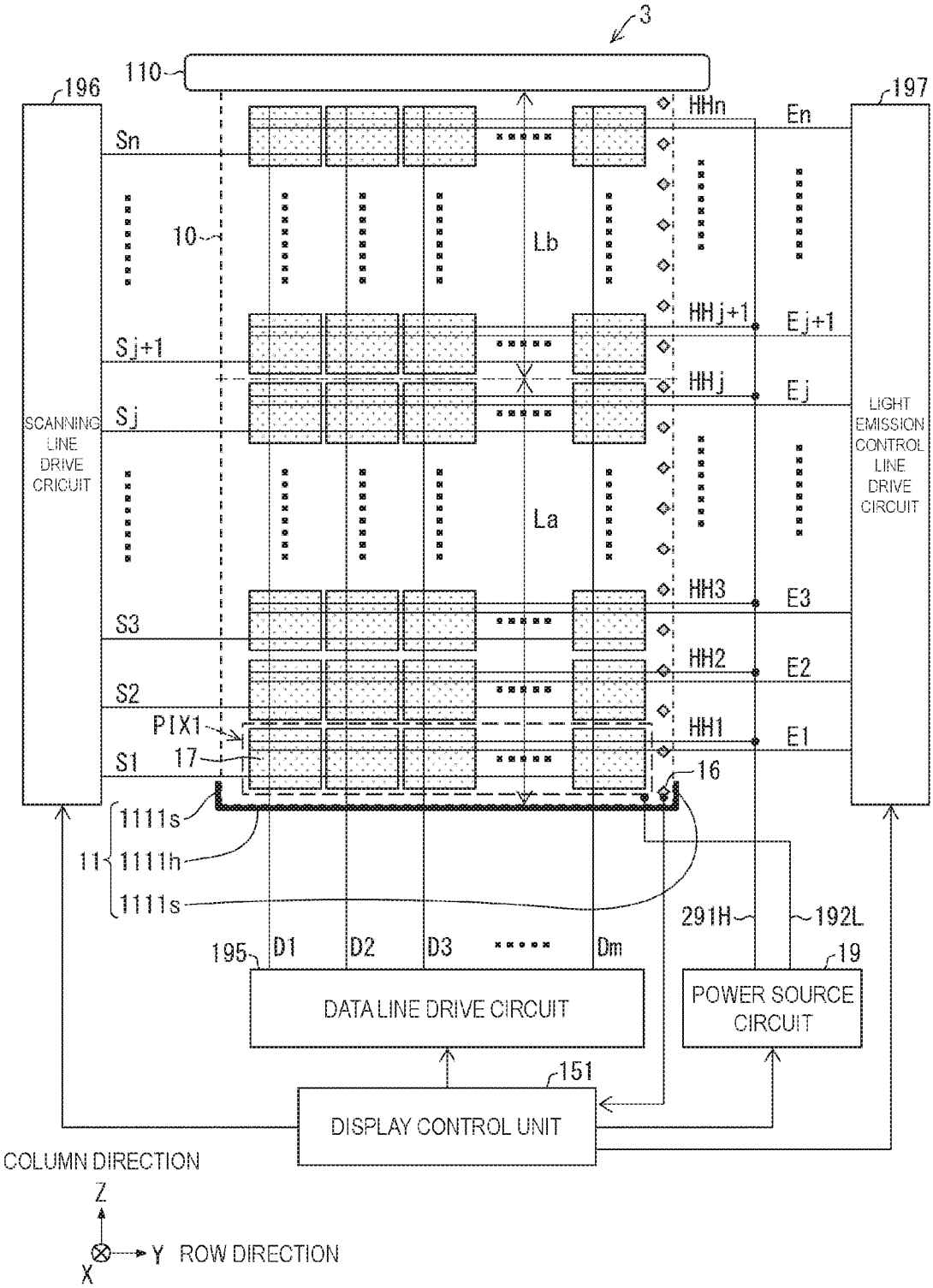
FIG. 14 is a view illustrating a display device of a third embodiment.

A description follows regarding a third embodiment of the disclosure with reference to FIG. 14. FIG. 14 is a view illustrating a display device 3 of the third embodiment. The display device 3 has configuration in which the first voltage primary wiring line 191H of the display device 1 of the first embodiment is replaced with a first voltage primary wiring line 291H. The first voltage primary wiring line 291H includes first voltage wiring lines HH1 to HHn.

Similar to the scanning wiring lines S1 to Sn and the light emission control wiring lines E1 to En, the first voltage wiring lines HH1 to HHn extend in the Y direction (row direction, second direction) and are provided parallel to each other along the Z direction (column direction, first direction). The first voltage wiring lines HH1 to HHn of the first voltage primary wiring line 291H are provided parallel to and corresponding one-to-one to the scanning wiring lines S1 to Sn and the light emission control wiring lines E1 to En.

In the display device 3, the first voltage primary wiring line 291H is connected to the pixel circuits 17 via the first voltage wiring lines HH1 to HHn. In this way, the direction in which the first voltage primary wiring line and the first voltage wiring lines are provided is not limited to the direction described in the first embodiment.

In the configuration of the display device 3 also, the drive current can be prevented from passing through the pixel circuits 17 included in the rolled area of the display unit 10 by using the drive methods described in (1) to (3) of the aforementioned embodiment. That is, it is possible to allow only the unrolled area of the display unit 10 to illuminate and prevent the rolled area from illuminating.

Modification

Figure 15:
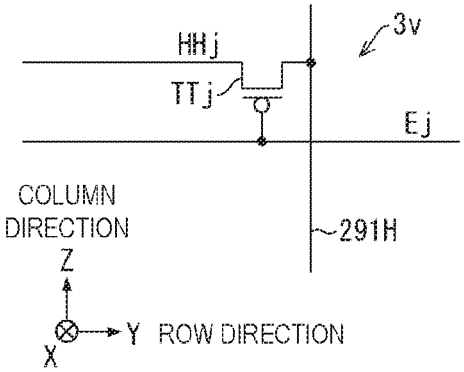
FIG. 15 is a view illustrating a modification of the display device of the third embodiment.

FIG. 15 is a view illustrating a display device 3*v* as the modification of the display device 3 of the third embodiment. In the display device 3*v*, switching elements TT1 to TTn (first switching elements) are provided on the first voltage wiring lines HH1 to HHn, respectively. In FIG. 15, a switching element TTj provided on the j-th first voltage wiring line HHj is illustrated. The switching elements, for example, may be TFTs.

In the display device 3*v*, when the pixel circuits 17 positioned in the j-th row are included in the unrolled area, the display control unit 151 may bring the switching element TTj into an ON state. Further, when the pixel circuits 17 positioned in the j-th row are included in the rolled area, the display control unit 151 may bring the switching element TTj into an OFF state. This prevents the first voltage from being applied to the pixel circuits 17 included in the rolled area. Thus, the current (passive current) attributed to the aforementioned parasitic capacitance and resistance can be suppressed. This configuration of the display device 3*v* can also prevent generation of heat in the rolled area.

As one example, the gate terminal of the switching element TTj may be electrically connected to a light emission control wiring line Ej corresponding to the first voltage wiring line HHj. Then, as described above, a control signal may be inputted only to the light emission control wiring line Ej corresponding to the pixel circuits included in the unrolled area. This configuration can also prevent generation of heat in the rolled area.

Fourth Embodiment

Figure 16:
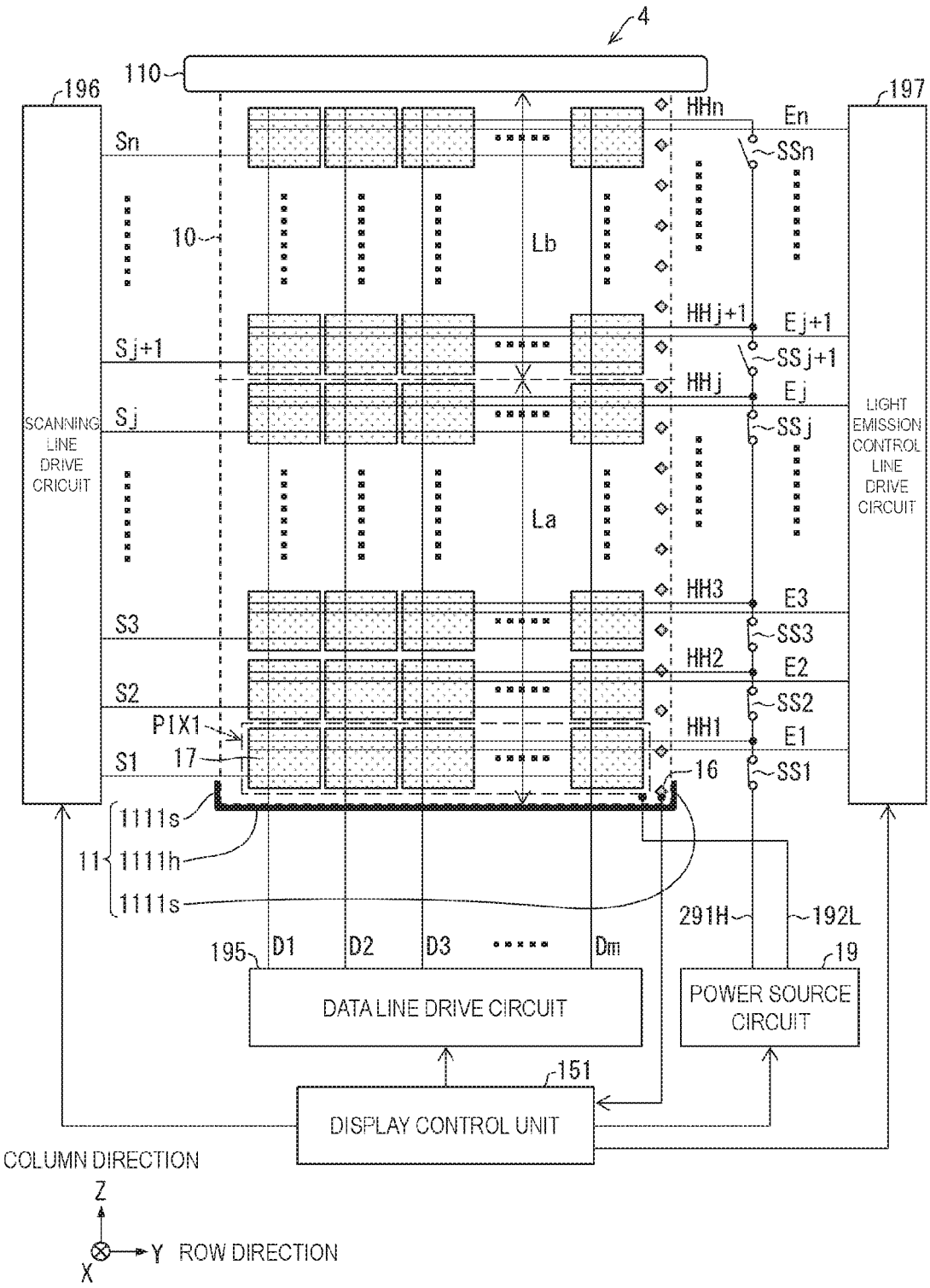
FIG. 16 is a view illustrating a display device of a fourth embodiment.

A description follows regarding a fourth embodiment of the disclosure with reference to FIG. 16. FIG. 16 is a view illustrating a display device 4 of the fourth embodiment. The display device 4 has configuration in which switching elements SS1 to SSn (second switching elements) are added to the first voltage primary wiring line 291H in the display device 3 of the third embodiment. The switching elements, for example, may be TFTs.

The switching element SSj in the j-th row is interposed between the first voltage primary wiring line 291H and the first voltage wiring line HHj in the j-th row. That is, the first voltage wiring line HHj in the j-th row is electrically connected to the first voltage primary wiring line 291H via the switching element SSj.

In the display device 4, when the pixel circuits 17 positioned in the j-th row are included in the unrolled area, the display control unit 151 brings the switching element SSj into an ON state. Similarly, when the pixel circuits 17 positioned in the j-th row are included in the rolled area, the display control unit 151 brings the switching element SSj into an OFF state. Similar to the third embodiment, the aforementioned configuration can also prevent generation of heat in the rolled area.

Note that the fourth embodiment exemplifies a case where one switching element is provided for each row. However, in the display device 4, one switching element may be provided for every plurality of rows (e.g., two rows).

Example Implemented by Software

A control block (in particular, the control unit 15) of the display devices 1 to 4 may be implemented by logic circuits (hardware) fabricated in integrated circuits (IC chips) or may be implemented by software using a Central Processing Unit (CPU).

In the case of the latter, the display devices 1 to 4 include the CPU that executes the commands of programs that are softwares for achieving each function, a Read Only Memory (ROM) or a storage device (these are referred to as "storage media") in which the programs and various data are stored to be readable by a computer (or CPU), a Random Access Memory (RAM) that loads the programs, and the like. Then, a computer (or CPU) reads the programs from the storage media and executes the programs, which achieves an object of the disclosure. As the storage media, "nonvolatile tangible media" such as tapes, disks, cards, semiconductor memories, programmable logic circuits can be employed. Further, the programs may be supplied to the computer via any transmission medium (communication network, broadcast wave, and the like) through which the programs can be transmitted. Note that one aspect of the present disclosure can be achieved in the form of data signals embodied by electronic transmission of the programs and embedded in a carrier wave.

Supplement

A display device of a first aspect includes: a display unit including a plurality of pixel circuits each including an electro-optic element, the display unit being deformable and having flexibility; a rolling mechanism configured to roll the display unit and store a rolled part of the display unit as a rolled area in an interior of the rolling mechanism; a power source circuit; a first voltage primary wiring line configured to supply a first voltage from the power source circuit to at least one of the plurality of pixel circuits; and a second voltage primary wiring line configured to supply a second voltage lower than the first voltage from the power source circuit to at least one of the plurality of pixel circuits, wherein an area of the display unit excluding the rolled area includes an unrolled area, and an end portion of the unrolled area of the display unit positioned on an opposite side with respect to the rolling mechanism includes a lowermost edge portion, and at least one of the first voltage primary wiring line and the second voltage primary wiring line is electrically connected to at least one pixel circuit arranged at the lowermost edge portion first, out of the plurality of pixel circuits.

In a second aspect, the first voltage primary wiring line is electrically connected to at least one pixel circuit arranged at the lowermost edge portion first, out of the plurality of pixel circuits.

In a third aspect, the second voltage primary wiring line is electrically connected to at least one pixel circuit arranged at the lowermost edge portion first, out of plurality of the pixel circuits.

In a fourth aspect, the display device further includes a plurality of first voltage wiring lines extending from the first voltage primary wiring line to the plurality of pixel circuits in a first direction, wherein the plurality of first voltage wiring lines are provided parallel to each other along a second direction intersecting with the first direction, and the first voltage primary wiring line is electrically connected to at least one pixel circuit arranged at the lowermost edge portion first, out of plurality of the pixel circuits, via the plurality of first voltage wiring lines.

In a fifth aspect, the electro-optic element includes a first electrode, a second electrode positioned above the first electrode, and a light emitting layer positioned between the first electrode and the second electrode, the second electrode including an integrated electrode commonly used for at least two of the plurality of pixel circuits, and the second electrode is electrically connected to the second voltage primary wiring line via a wire formed in a Thin Film Transistor (TFT) layer at the lowermost edge portion.

In a sixth aspect, the display device further includes: a plurality of data signal wiring lines configured to input an analog voltage signal corresponding to an image to be displayed on the display unit to the pixel circuits; a plurality of scanning wiring lines intersecting with the plurality of data signal wiring lines, and a plurality of light emission control wiring lines intersecting with the plurality of data signal wiring lines and corresponding one-to-one to the plurality of scanning wiring lines, wherein the plurality of data signal wiring lines extend to the plurality of pixel circuits in a first direction and are provided parallel to each other along a second direction intersecting with the first direction, and the plurality of scanning wiring lines and the plurality of light emission control wiring lines extend to the pixel circuits in the second direction and are provided parallel to each other along the first direction, and the plurality of pixel circuits are arranged in a matrix form along the first and second directions, the first direction being a direction parallel to a direction in which the display unit is drawn out from the rolling mechanism.

In a seventh aspect, the display device further includes a position sensor configured to detect the unrolled area.

In an eighth aspect, a scanning signal is inputted only to at least one scanning wiring line corresponding to the plurality of pixel circuits included in the unrolled area, out of the plurality of scanning wiring lines.

In a ninth aspect, a control signal is inputted only to at least one light emission control wiring line corresponding to the plurality of pixel circuits included in the unrolled area, out of the plurality of light emission control wiring lines.

In a tenth aspect, the analog voltage signal is inputted only to at least one data signal wiring line corresponding to the pixel circuits included in the unrolled area, out of the plurality of data signal wiring lines.

In an eleventh aspect, the display device further includes a display control unit configured to control the display unit, wherein the display control unit is configured to determine at least one target pixel circuit to which a signal is inputted, out of the plurality of pixel circuits, based on detection results of the position sensors.

In a twelfth aspect, the display control unit is configured to determine a section of the unrolled area on which the image is to be displayed, based on a length of the unrolled area drawn out from the rolling mechanism and an aspect ratio of the image to be displayed on the display unit.

In a thirteenth aspect, only electro-optic elements provided in at least one of the plurality of pixel circuits included in the unrolled area, out of the electro-optic elements, emit light.

In a fourteenth aspect, the display unit further includes a terminal configured to receive a signal inputted from outside, wherein the terminal is provided at the lowermost edge portion.

In a fifteenth aspect, the terminal is provided on a back side opposite to a front side of the display unit, the front side being a side where an active area of the display unit is provided.

In a sixteenth aspect, the lowermost edge portion includes a side end portion parallel to a first direction, and a main end portion parallel to a second direction intersecting with the first direction, the first direction being a direction parallel to a direction in which the display unit is drawn out from the rolling mechanism.

In a seventeenth aspect, the display device further includes a plurality of first voltage wiring lines provided parallel to each other along a first direction, wherein the plurality of first voltage wiring lines extend from the first voltage primary wiring line to the pixel circuits in a second direction, and the first voltage primary wiring line is electrically connected to at least one pixel circuit arranged at the lowermost edge portion first, out of the plurality of pixel circuits, via the plurality of first voltage wiring lines.

In an eighteenth aspect, first switching elements are provided on the plurality of first voltage wiring lines.

In a nineteenth aspect, gate terminals of the first switching elements are electrically connected to the plurality of light emission control wiring lines corresponding one-to-one to the plurality of first voltage wiring lines.

In a twentieth aspect, second switching elements are provided on the first voltage primary wiring line.

In a twenty-first aspect, a curvature of the lowermost edge portion successively changes.

In a twenty-second aspect, the display device includes a first display unit and a second display unit as the display unit, and an active area of the second display unit is provided on an opposite side with respect to an active area of the first display unit.

In a twenty-third aspect, the display unit includes an Electro Luminescence (EL) display having a sheet shape.

Additional Notes

The disclosure is not limited to each of the embodiments stated above, and various modifications may be implemented within a range not departing from the scope of the claims. Embodiments obtained by appropriately combining technical approaches stated in each of the different embodiments also fall within the scope of the technology of the disclosure. Moreover, novel technical features may be formed by combining the technical approaches disclosed in each of the embodiments.

REFERENCE SIGNS LIST

1, 1*u*, 1*v*, 2, 3, 4 Display device
10, 20 Display unit
10*f* Display unit (first display unit)
10*r* Display unit (second display unit)
11, 11*f*, 11*r*, 11*fv*, 11*rv* Edge portion (lowermost edge portion)
12, 12*f* Terminal
16, 16*f*, 16*r* Position sensor
17, 17*u* Pixel circuit
110, 110*f*, 110*r*, 210 Rolling mechanism
151 Display control unit
170, 170*r*, 170*g*, 170*n* Light emitting element (electro-optic element)
191H, 291H First voltage primary wiring line
192L Second voltage primary wiring line
900 Electrode (second electrode)
1111*h* Primary end portion
1111*s* Side end portion
Ar Display section
D1 to Dm Data signal wiring line
E1 to En Light emission control wiring line
S1 to Sn Scanning wiring line
SS1 to SSn Switching element (second switching element)
TTj Switching element (first switching element)
H1 to Hm, HH1 to HHn First voltage wiring line
La Length of rolled area
Lb Length of unrolled area
VDD Voltage (first voltage)
VSS, Vssr, Vssg, Vssb Voltage (second voltage)

The invention claimed is:

1. A display device comprising, a display including a plurality of pixel circuits each including an electro-optic element, the display being deformable and having flexibility;

a rolling mechanism that rolls the display and stores a rolled portion of the display was a rolled area in an interior of the rolling mechanism;

a power source circuit;

a first voltage primary wiring line that supplies a first voltage from the power source circuit to at least one of the plurality of pixel circuits; and a second voltage primary wiring line that supplies a second voltage lower than the first voltage from the power source circuit to at least one of the plurality of the pixel circuits; wherein, an area of the display excluding the rolled area includes an unrolled area, and an end portion of the unrolled area of the display positioned on an opposite side with respect to the rolling mechanism includes a lowermost edge portion, at least one of the first voltage primary wiring line and the second voltage primary wiring line is electrically connected to at least one pixel circuit arranged at the lowermost edge portion first, out of the plurality of pixel circuits, the display device further includes:

a plurality of data signal wiring lines that input an analog voltage signal corresponding to an image to be displayed on the display to the plurality of pixel circuits;

a plurality of scanning wiring lines intersecting with the plurality of data signal wiring lines; and a plurality of light emission control wiring lines intersecting with the plurality of data signal wiring lines and corresponding one-to-one to the plurality of scanning wiring lines, the plurality of data signal wiring lines extend to the plurality of pixel circuits in a first direction and are provided parallel to each other along a second direction intersecting with the first direction, the plurality of scanning wiring lines and the plurality of light emission control wiring lines extend to the plurality of pixel circuits in the second direction and are provided parallel to each other along the first direction, the plurality of pixel circuits are arranged in a matrix along the first direction and the second direction, and the first direction includes a direction parallel to a direction in which the display is drawn out from the rolling mechanism, the display device further includes a position sensor that detects the unrolled area, wherein a scanning signal is inputted only to at least one of the plurality of scanning wiring lines corresponding to at least one of the plurality of pixel circuits included in the unrolled area, out of the plurality of scanning wiring lines, a control signal is inputted only to at least one light emission control wiring line corresponding to at least one of the plurality of pixel circuits included in the unrolled area, out of the plurality of light emission control wiring lines, or the analog voltage signal is inputted only to at least one data signal wiring lines corresponding to at least one of the plurality of pixel circuits included in the unrolled area, out of the plurality of data signal wiring lines, a drive current first flows into the at least one pixel circuit arranged at the lowermost edge portion via the first voltage primary wiring line, and when images are displayed only on the unrolled area of the display, the drive current is passed through only the at least one of the plurality of pixel circuits included in the unrolled area without passing through the at least one of the plurality of pixel circuits included in the rolled area.

2. A display device according to claim 1, wherein the data signal wiring lines extend to the plurality of pixel circuits in a first direction and are provided parallel to each other along a second direction intersecting with the first direction, the plurality of scanning wiring lines and the plurality of light emission control wiring lines extend to the plurality of pixel circuits in the second direction and are provided parallel to each other along the first direction, the plurality of pixel circuits are arranged in a matrix along the first direction and the second direction, the first direction includes a direction parallel to a direction in which the display is drawn out from the rolling mechanism, the display device further includes:

a plurality of position sensors that detect the unrolled area; and display control circuitry that controls the display, and the display control circuitry determines at least one target pixel circuit to which a signal is inputted, out of the plurality of pixel circuits, based on detection results of the plurality of position sensors.

3. The display device according to claim 2, wherein the display control circuitry determines a section of the unrolled area on which the image is to be displayed, based on a length of the unrolled area drawn out from the rolling mechanism and an aspect ratio of the image to be displayed on the display.

4. The display device according to claim 1, wherein only electro-optic elements provided in at least one of the plurality of pixel circuits included in the unrolled area, out of the electro-optic elements, emit light.

5. The display device according to claim 1, wherein the display further includes a terminal that receives a signal inputted from outside, and the terminal is provided at the lowermost edge portion.

6. The display device according to claim 5, wherein the terminal is provided on a back side opposite to a front side of the display, the front side being a side where an active area of the display is provided.

7. The display device according to claim 1, wherein the lowermost edge portion includes:

a side end portion parallel to the first direction; and a main end portion parallel to the second direction intersecting with the first direction, and the first direction includes a direction parallel to the direction in which the display is drawn out from the rolling mechanism.

8. The display device according to claim 1, further comprising a plurality of first voltage wiring lines provided parallel to each other along the first direction, wherein the plurality of first voltage wiring lines extend from the first voltage primary wiring line to the plurality of pixel circuits in the second direction, and a plurality of first voltage primary wiring lines are electrically connected to the plurality of pixel circuits arranged at the lowermost edge portion first, out of the plurality of pixel circuits, via the first voltage wiring lines.

9. A display device comprising:

a display including a plurality of pixel circuits each including an electro-optic element, the display being deformable and having flexibility;

a rolling mechanism that rolls the display and store a rolled portion of the display as a rolled area in an interior of the rolling mechanism;

a power source circuit;

a first voltage primary wiring line that supplies a first voltage from the power source circuit to at least one of the plurality of pixel circuits; and a second voltage primary wiring line that supplies a second voltage lower than the first voltage from the power source circuit to at least one of the plurality of pixel circuits; wherein, an area of the display excluding the rolled area includes an unrolled area, and an end portion of the unrolled area of the display positioned on an opposite side with respect to the rolling mechanism includes a lowermost edge portion, at least one of the first voltage primary wiring line and the second voltage primary wiring line is electrically connected to at least one pixel circuit arranged at the lowermost edge portion first, out of the plurality of pixel circuits, the display device further includes:

a plurality of first voltage wiring lines provided parallel to each other along a first direction, the plurality of first voltage wiring lines extend from the first voltage primary wiring line to the pixel circuits in a second direction, and a plurality of first voltage primary wiring lines are electrically connected to a plurality of pixel circuits arranged at the lowermost edge portion first, out of the plurality of pixel circuits, via the plurality of first voltage wiring lines, first switching elements are provided on the plurality of first voltage wiring lines, display control circuitry controls the at least one pixel circuit, when one pixel circuit of the at least one of the plurality of pixel circuits is included in the unrolled area, the display control circuitry switches one first switching element of the first switching elements corresponding to the one pixel circuit into an ON state, and when the one pixel circuit is included in the rolled area, the display control circuitry switches the one first switching element into an OFF state and prevents voltage from being applied to the one pixel circuit included in the rolled area.

10. The display device according to claim 9, wherein gate terminals of the first switching elements are electrically connected to a plurality of light emission control wiring lines corresponding one-to-one to the plurality of first voltage wiring lines.

11. A display device comprising:

a display including a plurality of pixel circuits each including an electro-optic element, the display being deformable and having flexibility;

a rolling mechanism that rolls the display and store a rolled portion of the display as a rolled area in an interior of the rolling mechanism;

a power source circuit;

a first voltage primary wiring line that supplies a first voltage from the power source circuit to at least one of the plurality of pixel circuits; and a second voltage primary wiring line that supplies a second voltage lower than the first voltage from the power source circuit to at least one of the plurality of pixel circuits, wherein, an area of the display excluding the rolled area on the display includes an unrolled area, and an end portion of the unrolled area of the display opposite side with respect to the rolling mechanism includes a lowermost edge portion, at least one of the first voltage primary wiring line and the second voltage primary wiring line is electrically connected to at least one pixel circuit arranged at the lowermost edge portion first, out of the plurality of pixel circuits, second switching elements are provided on the first voltage primary wiring line, display control circuitry that controls at least one pixel circuit, when one pixel circuit of the at least one of the plurality of pixel circuits is included in the unrolled area, the display control circuitry switches one second switching element of the second switching elements corresponding to the one pixel circuit into an ON state, and when the one pixel circuit is included in the rolled area, the display control circuitry switches the one second switching element into an OFF state and prevents voltage from being applied to the one pixel circuit included in the rolled area.

12. The display device according to claim 1, wherein a curvature of the lowermost edge portion successively changes.

13. The display device according to claim 1, wherein a first display and a second display are included in the display, and an active area of the second display is provided on an opposite side with respect to an active area of the first display.

14. The display device according to claim 1, wherein the display includes an Electro Luminescence (EL) display having a sheet shape.

15. The display device according to claim 9, wherein a scanning signal is inputted only to at least one scanning wiring line corresponding to the plurality of pixel circuits included in the unrolled area, out of a plurality of scanning wiring lines, a control signal is inputted only to at least one light emission control wiring line corresponding to the plurality of pixel circuits included in the unrolled area, out of a plurality of light emission control wiring lines, or an analog voltage signal is inputted only to at least one data signal wiring line corresponding to the plurality of pixel circuits included in the unrolled area, out of a plurality of data signal wiring lines.

16. The display device according to claim 11, wherein a scanning signal is inputted only to at least one scanning wiring line corresponding to the plurality of pixel circuits included in the unrolled area, out of a plurality of scanning wiring lines, a control signal is inputted only to at least one light emission control wiring line corresponding to the plurality of pixel circuits included in the unrolled area, out of light emission control wiring lines, or an analog voltage signal is inputted only to at least one data signal wiring line corresponding to the plurality of pixel circuits included in the unrolled area, out of a plurality of data signal wiring lines.

17. The display device according to claim 1, wherein the first voltage primary wiring line is electrically connected to at least one pixel circuit arranged at the lowermost edge portion first, out of the plurality of pixel circuits.

18. The display device according to claim 1, wherein the second voltage primary wiring line is electrically connected to at least one pixel circuit arranged at the lowermost edge portion first, out of the plurality of pixel circuits.

19. The display device according to claim 1, wherein the electro-optic element includes:

a first electrode;

a second electrode positioned above the first electrode; and a light emitting layer positioned between the first electrode and the second electrode, wherein the second electrode includes an integrated electrode commonly used for at least two of the plurality of pixel circuits, and the second electrode is electrically connected to the second voltage primary wiring line via a wire defined in a Thin Film Transistor (TFT) layer at the lowermost edge portion.

* * * * *